US008598960B2

(12) United States Patent
Blaser et al.

(10) Patent No.: US 8,598,960 B2
(45) Date of Patent: Dec. 3, 2013

(54) WAVEGUIDE POLARIZERS

(75) Inventors: Bruce Larry Blaser, Auburn, WA (US); John B. O'Connell, Seattle, WA (US)

(73) Assignee: The Boeing Company, Chicago, IL (US)

( * ) Notice: Subject to any disclaimer, the term of this patent is extended or adjusted under 35 U.S.C. 154(b) by 1043 days.

(21) Appl. No.: 12/362,199

(22) Filed: Jan. 29, 2009

(65) Prior Publication Data

US 2010/0188305 A1 Jul. 29, 2010

(51) Int. Cl.
*H01P 1/17* (2006.01)

(52) U.S. Cl.
USPC ..... 333/21 A; 333/208

(58) Field of Classification Search
USPC ..... 333/21 R, 21 A, 208
See application file for complete search history.

(56) References Cited

U.S. PATENT DOCUMENTS 2,934,762 A 4/1960 Smedes
4,100,514 A * 7/1978 DiTullio et al. ..... 333/157
4,523,160 A 6/1985 Ploussios
4,785,306 A 11/1988 Adams
4,942,377 A * 7/1990 Ishikawa et al. ..... 333/202
5,304,999 A 4/1994 Roberts et al.
6,285,267 B1 * 9/2001 Hauth et al. ..... 333/210
6,331,809 B1 * 12/2001 Takakuwa et al. ..... 333/135
6,624,715 B2 * 9/2003 Yuanzhu ..... 333/21 A
6,664,866 B2 * 12/2003 Yoneda et al. ..... 333/21 A
7,414,491 B2 * 8/2008 Higgins ..... 333/12

OTHER PUBLICATIONS

Virone et al., "A novel design tool for waveguide polarizers," IEEE Transactions on Microwave Theory and Techniques, vol. 53, Iss. 3, Mar. 2005, pp. 888-894 (abstract), abstract only.
Yoneda et al., "A design of novel grooved circular waveguide polarizers," IEEE Transactions on Microwave Theory and Techniques, vol. 48, Iss. 12, Dec. 2000, pp. 2446-2452 (abstract), abstract only.

* cited by examiner

*Primary Examiner* — Dean O Takaoka
*Assistant Examiner* — Alan Wong
(74) *Attorney, Agent, or Firm* — Yee & Associates, P.C.

(57) ABSTRACT

A method and apparatus for a polarizer. The apparatus comprises a dielectric rod, a first array of slots, and a second array of slots. The first array of slots and the second array of slots are formed in sidewalls of the dielectric rod. The first array of slots is substantially opposite to the second array of slots. The first array of slots and the second array of slots are configured to shift a first component orthogonal to a second component in a signal traveling through the dielectric rod by around 90 degrees with respect to each other. The dielectric rod may be a solid material or comprised of layers of dielectric substrates with metal tabs.

10 Claims, 19 Drawing Sheets

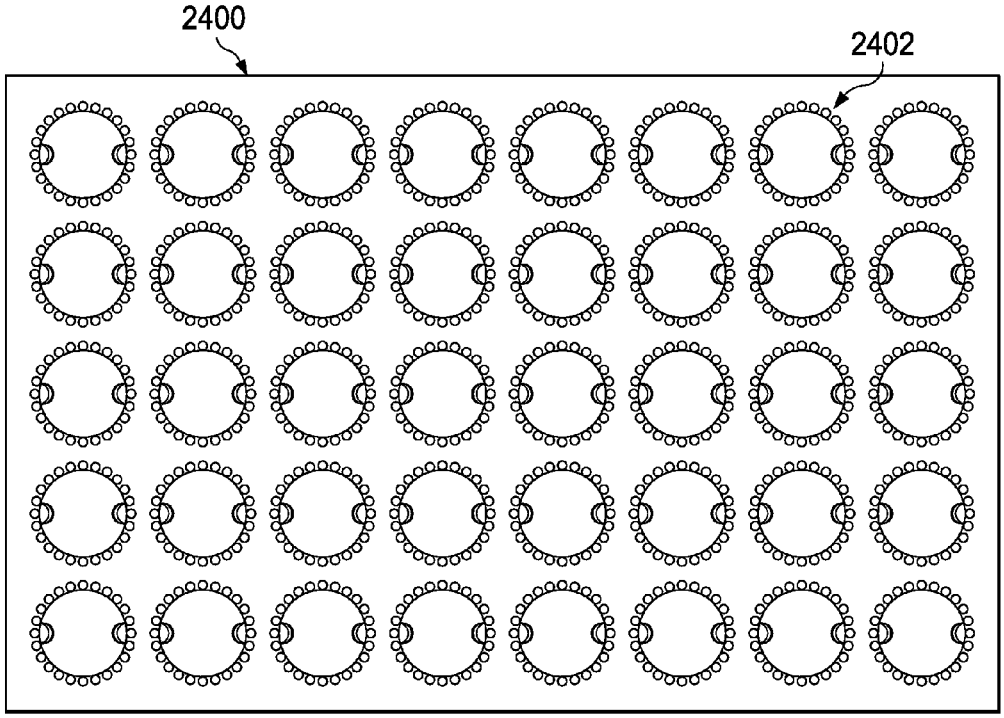

FIG. 24

2500

| | 2502 POLARIZER DESCRIPTION | 2504 FREQUENCY BAND | 2506 RETURN LOSS | 2508 INSERTION LOSS | 2510 CROSS POLARIZATION | 2512 DELTA PHASE |
|---|---|---|---|---|---|---|
| | | (GHz) | (dB) | (dB) | (dB) | (Degrees) |
| 2514 | DIELECTRIC ROD WITH EDGE METAL PLATING | 43.5 - 45.5 | >44 | <0.07 | >58 | 88.7 - 89.0 |
| 2516 | DIELECTRIC ROD WITHOUT EDGE METAL PLATING | 43.5 - 45.5 | >20 | <0.10 | >50 | 89.9 - 91.0 |
| 2518 | CYLINDER OF SUBSTRATES WITH EDGE METAL PLATING, 5 IRISES | 43.5 - 45.5 | >29 | <0.08 | >50 | 84.6 - 91.0 |
| 2520 | CYLINDER OF SUBSTRATES WITH EDGE METAL PLATING, 8 IRISES | 43.5 - 45.5 | >34 | <0.30 | >55 | 89.6 - 90.2 |
| 2522 | CYLINDER OF SUBSTRATES WITH EDGE METAL PLATING AND VIAS | 43.5 - 45.5 | >19 | <0.36 | >63 | 88.0 - 90.0 |

FIG. 25

WAVEGUIDE POLARIZERS

BACKGROUND INFORMATION

1. Field

The present disclosure relates generally to antennas and, in particular, to wave guide polarizers for antennas. Still more particularly, the present disclosure relates to circular polarizers for antennas.

2. Background

A phased array antenna is a group of antennas in which the relative phases of the respective signals feeding the antennas may be varied in a way that the effect of radiation pattern of the array is reinforced in a desired direction and suppressed in undesired directions. In other words, one or more beams may be generated that may be pointed in or steered into different directions. A beam pointing in a transmitting or receiving phased array antenna is achieved by controlling the phasing timing of the transmitted or received signal from each antenna element in the array.

The individual radiated signals are combined to form the constructive and destructive interference patterns of the array. A phased array antenna may be used to point one or more fixed beams or to scan one or more beams rapidly in azimuth or elevation.

Each antenna element in a phased array antenna may employ a polarizer. This polarizer converts a signal in a circular polarized form to a linearly polarized form or visa versa. Signals that are transmitted from an antenna may be converted from a linear polarized form to a circular polarized form for transmission. The conversion for an array receiving a signal is converted from circular to linear polarization. This conversion can be accomplished by these same devices. Further discussion is limited to the transmit case for brevity but inversely (conversion from circular to linear) also applies for the receive case. A polarizer may be placed within a waveguide and may be formed using different dielectric materials.

It is desirable to transform a linear polarized signal in a circular waveguide into a circular polarized signal in a manner with low loss, good matching, and a good fit within the cross section of the waveguide. Existing solutions for polarizers may involve a non-circular cross section in the waveguide to obtain the desired polarization of signals. These types of waveguides may require expensive manufacturing techniques. Further, these types of polarizers also may be more difficult to match.

Therefore, it would be advantageous to have a method and apparatus that takes into account one or more of the issues discussed above.

SUMMARY

In one advantageous embodiment, an apparatus comprises a dielectric rod, a first array of slots, and a second array of slots. The first array of slots and the second array of slots are formed in sidewalls of the dielectric rod. The first array of slots is substantially opposite to the second array of slots. The first array of slots and the second array of slots are configured to shift a first component orthogonal to a second component in a signal traveling through the dielectric rod by around 90 degrees with respect to each other.

In another advantageous embodiment, an apparatus comprises a cylinder of dielectric substrates, a first array of conductive tabs, and a second array of conductive tabs. The cylinder of dielectric substrates is stacked in layers, and the cylinder has walls with edge metal plating on the walls. The first array of conductive tabs is joined to a portion of the edge metal plating. The second array of conductive tabs is substantially opposite to the first array of conductive tabs and joined to a portion of the edge metal plating. The first array of conductive tabs and the second array of conductive tabs are configured to shift a first component orthogonal to a second component in a signal traveling through the cylinder of dielectric substrates by around 90 degrees with respect to each other.

In yet another advantageous embodiment, an antenna system comprises a controller and an antenna array having a plurality of antenna elements connected to the controller. Each antenna element in the plurality of antenna elements comprises a polarizer selected from one of a first polarizer and a second polarizer. The first polarizer has a dielectric rod; a first array of slots formed in sidewalls of the dielectric rod; and a second array of slots formed in the sidewalls of the dielectric rod. The first array of slots is substantially opposite to the second array of slots, and the first array of slots and the second array of slots are configured to shift a first component orthogonal to a second component in a signal traveling through the dielectric rod by around 90 degrees with respect to each other. The second polarizer has a cylinder of dielectric substrates stacked in layers in which a number of the dielectric substrates have edge metal plating formed on the number of the dielectric substrates; a first array of conductive tabs joined to a first portion of the edge metal plating; and a second array of conductive tabs substantially opposite to the first array of conductive tabs and joined to a second portion of the edge metal plating. The first array of conductive tabs and the second array of conductive tabs are configured to shift a first component orthogonal to a second component in a signal traveling through the cylinder of dielectric substrates by around 90 degrees with respect to each other.

In still yet another advantageous embodiment, a method for manufacturing a polarizer is present. Parameters are identified for a dielectric rod, a first array of slots, and a second array of slots, wherein the first array of slots is substantially opposite to the second array of slots. The first array of slots and the second array of slots are formed in sidewalls of the dielectric rod such that a first component orthogonal to a second component in a signal traveling through the dielectric rod shifts by around 90 degrees with respect to each other.

In another advantageous embodiment, a method is present for manufacturing a polarizer. Parameters are identified for a cylinder of dielectric substrates, a first array of conductive tabs, and a second array of conductive tabs. The cylinder of dielectric substrates stacked in layers is formed in which a number of the dielectric substrates have edge metal plating formed on the number of the dielectric substrates. A first array of conductive tabs joined to a first portion of the edge metal plating in the cylinder of dielectric substrates is formed. A second array of conductive tabs is formed in the cylinder of dielectric substrates substantially opposite to the first array of conductive tabs. The second array of conductive tabs is joined to a second portion of the edge metal plating. The first array of tabs and the second array of tabs are configured to shift a first component orthogonal to a second component in a signal traveling through the cylinder of dielectric substrates by around 90 degrees with respect to each other.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives, and advantages thereof, will best be understood by reference to the following detailed description of an advantageous embodiment of the present disclosure when read in conjunction with the accompanying drawings, wherein:

FIG. 24 is a top view of a diagram illustrating an array of polarizers in accordance with an advantageous embodiment;

FIG. 25 is a table illustrating performance of polarizers in accordance with an advantageous embodiment;

DETAILED DESCRIPTION

Figure 1:
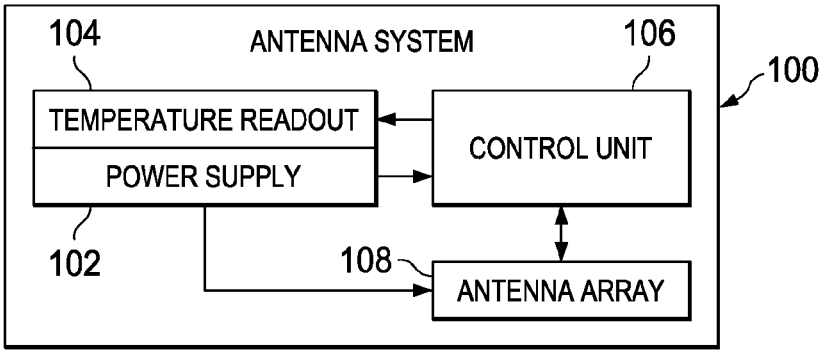
FIG. 1 is a diagram illustrating a configuration of an antenna system in accordance with an advantageous embodiment.

With reference now to the figures and, in particular, with reference to FIG. 1, a diagram illustrating a configuration of an antenna system is depicted in accordance with an advantageous embodiment. In this example, antenna system 100 includes power supply 102, temperature readout 104, control unit 106, and antenna array 108. In these illustrative examples, power supply 102 provides power to control unit 106 and antenna array 108.

Control unit 106 controls the array pointing angle for antenna array 108. Antenna array 108 may be either a single- or multi-beam antenna. Antenna array 108 also may be a transmit antenna and/or receive antenna in these illustrative examples.

Control unit 106 takes data from antenna array 108 and sends that data to temperature readout 104 for presentation to an operator and for automatic power down features.

In the different advantageous embodiments, antenna array 108 may employ circular polarizers according to one or more different advantageous embodiments.

Figure 2:
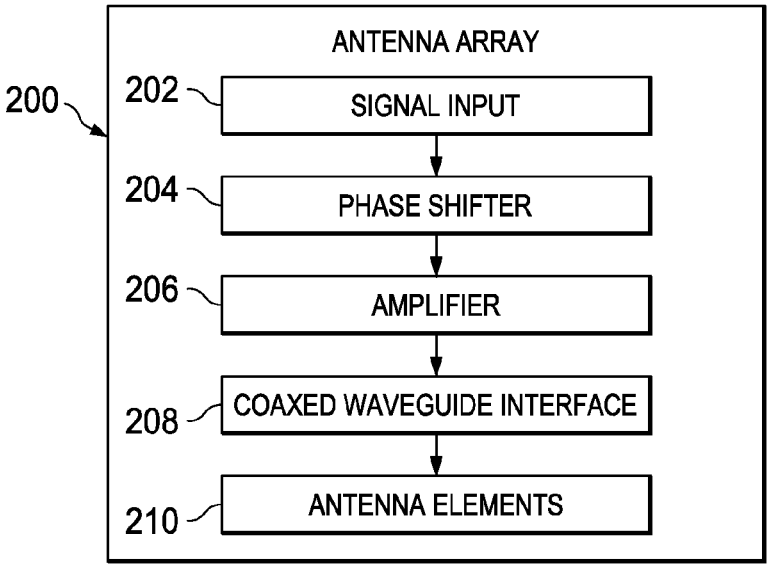
FIG. 2 is a diagram illustrating an antenna array in accordance with an advantageous embodiment.

With reference now to FIG. 2, a diagram illustrating an antenna array is depicted in accordance with an advantageous embodiment. In this example, antenna array 200 is an example of one implementation for antenna array 108 in FIG. 1. As illustrated, antenna array 200 includes signal input 202, phase shifter 204, amplifier 206, coaxed waveguide interface 208, and antenna elements 210.

Signal input 202 may receive a radio frequency (RF) signal for transmission. Phase shifter 204 performs phase shifting of signals in accordance with instructions from control unit 106 in FIG. 1. Amplifier 206 amplifies the radio frequency signal output of phase shifter 204 for transmission. Coaxed waveguide interface 208 provides a connection from amplifier 206 to antenna elements 210.

Figure 3:
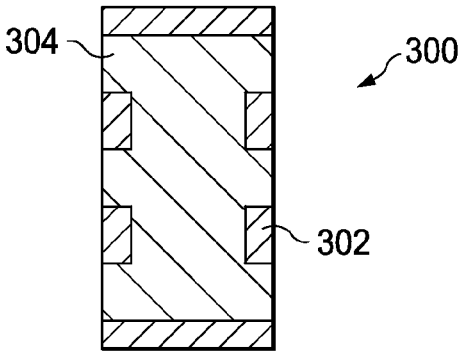
FIG. 3 is a diagram illustrating an antenna element in accordance with an advantageous embodiment.

With reference now to FIG. 3, a diagram illustrating an antenna element is depicted in accordance with an advantageous embodiment. In this example, antenna element 300 is an example of an antenna element within antenna elements 210 in FIG. 2. Antenna element 300 is an antenna that may be formed by circular waveguide 302 and polarizer 304.

The different advantageous embodiments may be implemented in polarizer 304 to provide for polarization in a manner that may include low loss, good matching, and a good fit to a round cross section for antenna element 300. Antenna element 300 may receive a linear signal from coaxed waveguide interface 208 in FIG. 2. This linear signal can be described as two equal orthogonal vectors that, when summed together, equal the input linear signal. The linear signal may be circularly polarized by delaying one vector by around 90 degrees using polarizer 304. This delay may be referred to as shifting the vector relative to the other vector.

In one advantageous embodiment, an apparatus comprises a dielectric rod, a first array of slots, and a second array of slots. The first array of slots and the second array of slots are formed in the sidewalls of the dielectric rod. The first array of slots is substantially opposite to the second array of slots. The dielectric rod is metal plated except for the two circular rod ends. The slots are included in the edge metal plating.

This edge metal plating forms the outer walls of the circular waveguide structure. The first array of slots and the second array of slots are configured to shift a signal with a transverse electric (TE) field orientation parallel to the slots and traveling through the dielectric rod, by around 90 degrees, with respect to a transverse electric field orientated perpendicular to the slots and also traveling through the dielectric rod. The two input orthogonal transverse electric fields are the equivalent mathematical description of a single linear transverse electric field orientated at 45 degrees with respect to the slots.

In another advantageous embodiment, an apparatus comprises a dielectric rod, a first array of slots, and a second array of slots. The first array of slots and the second array of slots are formed in the sidewalls of the dielectric rod. The first array of slots is substantially opposite to the second array of slots. The dielectric rod is not metal plated anywhere, but the whole rod must be placed into a metal tube to form the circular waveguide.

The first array of slots and the second array of slots are configured to shift a signal, with a transverse electric field orientation parallel to the slots and traveling through the dielectric rod, by around 90 degrees, with respect to a transverse electric field orientated perpendicular to the slots and also traveling through the dielectric rod. The two input orthogonal transverse electric fields are the equivalent mathematical description of a single linear transverse electric field orientated at 45 degrees with respect to the slots.

In another advantageous embodiment, an apparatus comprises a cylinder of laminated dielectric laminates, a first array of conductive tabs, and a second array of conductive tabs. These conductive tabs are typically formed by a chemical copper pattern etching process known in the industry as printed wiring board (PWB) fabrication. A number of dielectric laminates which have been pattern etched are stacked in layers and laminated. The printed wiring board is routed to form individual polarizing cylinders which are edge plated, usually with copper, to make physical contact with the conductive tabs.

The plating is referred to as edge metal plating and forms the outer walls of the circular waveguide structure. The first array of conductive tabs is joined to a first portion of the edge metal plating, and the second array of conductive tabs is joined to a second portion of the edge metal plating. The second array of conductive tabs is substantially opposite to the first array of conductive tabs. The first array of conductive tabs and the second array of conductive tabs are configured to shift two orthogonal transverse electric signals traveling through the cylinder of dielectric laminates by around 90 degrees with respect to each other.

In another advantageous embodiment, an apparatus comprises a cylinder of laminated dielectric laminates, a first array of conductive tabs, and a second array of conductive tabs. These conductive tabs are typically formed by printed wiring board fabrication. A number of dielectric laminates which have been pattern etched are stacked in layers and laminated. Rather than routing the individual elements, as in the above embodiment, the outer wall of the polarizers is formed by a ring of grounding vias through all layers. These vias are physically connected to pattern etched metal ground planes in the printed wiring board. The ground vias form the outer walls of a circular waveguide for an individual polarizer. The first array of conductive tabs is joined to a portion of the grounding vias, and the second array of conductive tabs is joined to a portion of the grounding vias.

The second array of conductive tabs is substantially opposite to the first array of conductive tabs. The first array of conductive tabs and the second array of conductive tabs are configured to shift two orthogonal transverse electric signals traveling through the cylinder of dielectric laminates by around 90 degrees with respect to each other. By using multiple rings in a printed wiring board, an array of polarizers can be manufactured simultaneously with the correct array spacing so as to enable placement in a phased array. A phased array is an antenna comprised of many antennas with individually adjusted phasing so as to achieve an additive signal in a unique direction.

Figure 4:
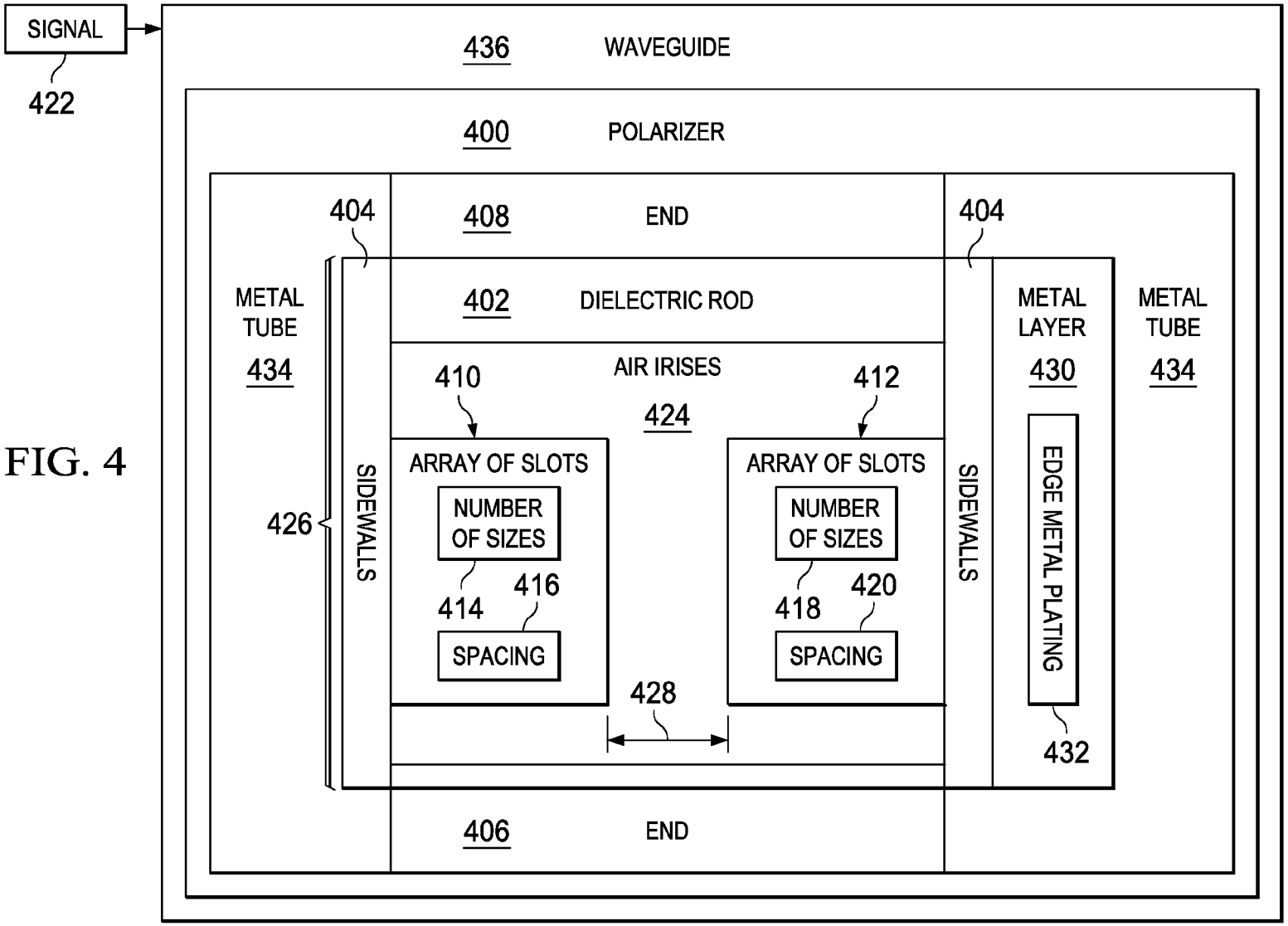
FIG. 4 is a diagram of a polarizer in accordance with an advantageous embodiment.

With reference now to FIG. 4, a diagram of a polarizer is depicted in accordance with an advantageous embodiment. In this example, polarizer 400 is an example of a polarizer that may be used to implement polarizer 304 in antenna element 300 in FIG. 3.

Dielectric rod 402 has sidewalls 404, end 406, and end 408. Dielectric rod 402 also has array of slots 410 and array of slots 412 formed in sidewalls 404. Array of slots 410 is substantially opposite to array of slots 412. Array of slots 410 and array of slots 412 may have two or more slots. In these examples, an array refers to two or more items arranged in an array. Array of slots 410 has number of sizes 414 and spacing 416. Array of slots 412 has number of sizes 418 and spacing 420. Spacing 416 represents the spacing between slots in array of slots 410. Spacing 416 may be even or may be uneven between different slots within array of slots 410. In a similar fashion, spacing 420 for array of slots 412 may be the same spacing or different spacing between different slots within array of slots 412.

Number of sizes 414 in array of slots 410 is selected to create a phase shift as signal 422 passes through dielectric rod 402. Signal 422 may have two equal orthogonal vectors. Signal 422 may be circular polarized by shifting one of these vectors by around 90 degrees. Array of slots 410 and array of slots 412 in dielectric rod 402 form air irises 424 in dielectric rod 402. The size and number of slots within array of slots 410 and array of slots 412 are selected to obtain around a 90 degree difference in phase as signal 422 passes through dielectric rod 402.

Array of slots 410 and array of slots 412 affect diameter 428 of dielectric rod 402 with respect to signal 422 travelling through dielectric rod 402. As the sizes of slots within array of slots 410 and array of slots 412 get larger, waveguide diameter 428 decreases, increasing the speed of phase velocity for one component of signal 422. As slots within array of slots 410 and array of slots 412 get smaller, diameter 428 increases. This increase in diameter 428 slows down the phase velocity of signal 422. The selection of sizes within number of sizes 414 for array of slots 410 and number of sizes 418 for array of slots 412 are selected to obtain around a 90 degree difference in phase.

Further, the number of slots within array of slots 410 and array of slots 412 as well as spacing 416 for array of slots 410 and spacing 420 for array of slots 412 may be selected to cancel out frequencies. A slot within array of slots 410 may cancel a reflection that may have occurred from a subsequent slot in dielectric rod 402. With more slots within array of slots 410 and array of slots 412, increased capability to cancel reflections occurs. When the number of slots within array of slots 410 and array of slots 412 is reduced, length 426 of dielectric rod 402 may be reduced.

In the advantageous embodiments, dielectric rod 402 may have metal layer 430. Metal layer 430 may take the form of edge metal plating 432. Edge metal plating 432 is a metal layer that is formed on sidewalls 404 of dielectric rod 402.

Metal layer 430 is present on sidewalls 404 but not ends 406 and 408 of dielectric rod 402. Metal layer 430 may form a waveguide for polarizer 400. As a result, polarizer 400 may not need a separate waveguide. This type of design may reduce the weight and complexity for creating antenna elements.

In some advantageous embodiments, dielectric rod 402 may not include metal layer 430. Instead, dielectric rod 402 may be placed into metal tube 434. Metal tube 434 may form waveguide 436. As a result, waveguide 436 and polarizer 400 may form an antenna element.

Figure 5:
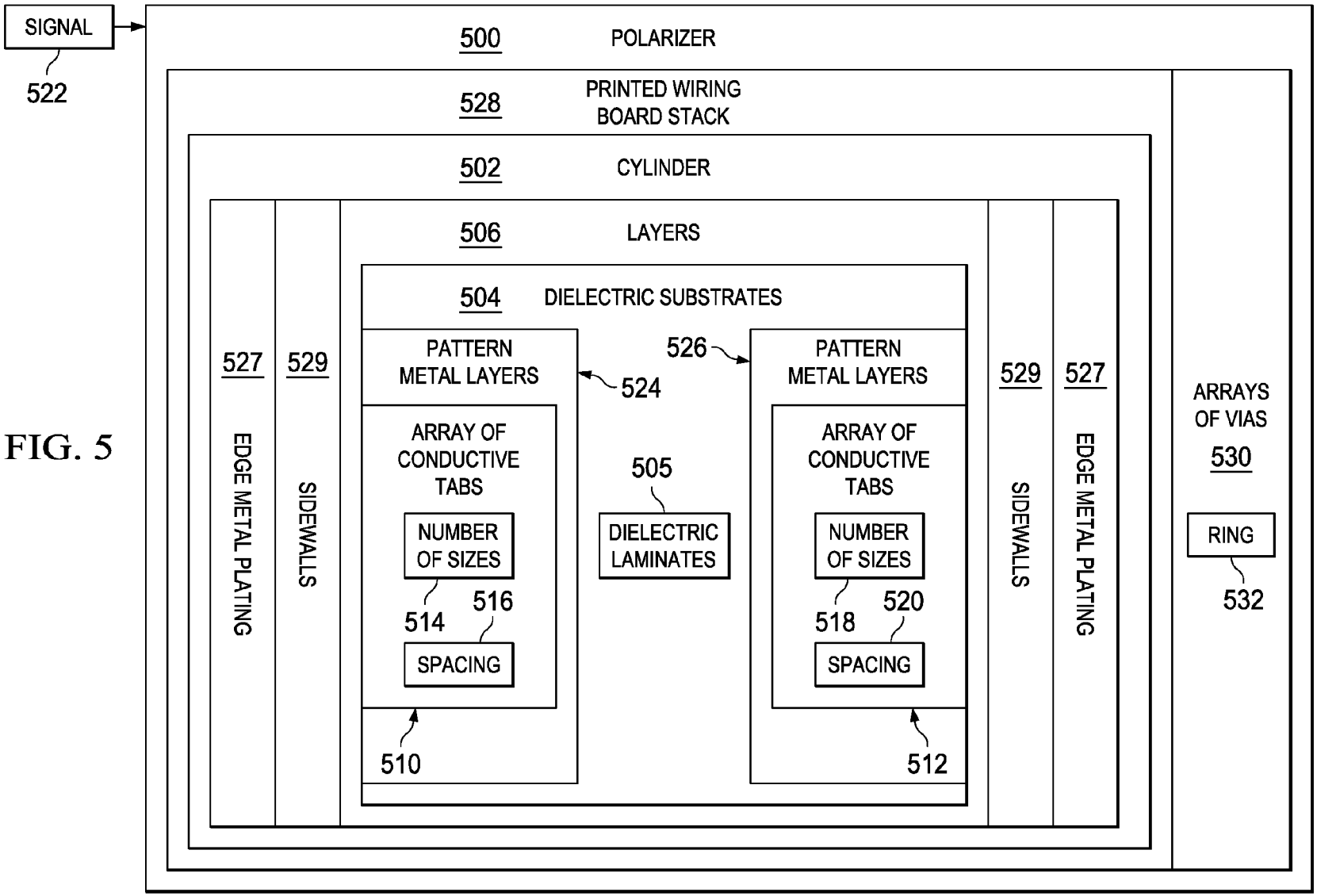
FIG. 5 is a diagram of a polarizer in accordance with an advantageous embodiment.

With reference now to FIG. 5, a diagram of a polarizer is depicted in accordance with an advantageous embodiment. In this example, polarizer 500 is an example of a polarizer that may be used for polarizer 304 in FIG. 3 to form antenna element 300.

Polarizer 500 has cylinder 502. Cylinder 502 is a dielectric cylinder formed from dielectric substrates 504 stacked in layers 506. Dielectric substrates 504 may take the form of dielectric laminates 505. A dielectric laminate is a material constructed by joining two or more layers of material that are non-conducting.

Additionally, array of conductive tabs 510 and array of conductive tabs 512 are formed on a number of dielectric substrates 504. Array of conductive tabs 510 has number of sizes 514 and spacing 516. Array of conductive tabs 512 has number of sizes 518 and spacing 520. In these examples, array of conductive tabs 510 is substantially opposite of array of conductive tabs 512.

In a similar fashion to the array of slots described with respect to polarizer 400 in FIG. 4, number of sizes 514 and spacing 516 for array of conductive tabs 510 and number of sizes 518 and spacing 520 for array of conductive tabs 512 may be selected to change a phase velocity of two orthogonal components in signal 522 travelling through polarizer 500 in a manner that results in a 90 degree shift in phase within the two orthogonal components in signal 522 with respect to each other.

In these examples, array of conductive tabs 510 takes the form of pattern metal layers 524 on dielectric substrates 504, and array of conductive tabs 512 takes the form of pattern metal layers 526 on dielectric substrates 504. These arrays of conductive tabs 510 and 512 are connected using edge metal plating 527 along sidewalls 529 of dielectric laminates 505.

These different components may take the form of printed wiring board stack 528. With this type of implementation, polarizer 500 may be manufactured using currently available printed wiring board processes.

In some advantageous embodiments, polarizer 500 also may include arrays of vias 530 arranged in ring 532 around cylinder 502. Ring 532 of arrays of vias 530 encompasses array of conductive tabs 510 and array of conductive tabs 412. Each via within an array of vias is electrically connected to another via adjacent to that via.

The illustrations of polarizer 400 in FIG. 4 and polarizer 500 in FIG. 5 are not meant to imply physical or architectural limitations to the manner in which different advantageous embodiments may be implemented. Other components may be used in addition to, or in place of, the ones illustrated. Further, in some advantageous embodiments, some of the components illustrated may be unnecessary.

Figure 6:
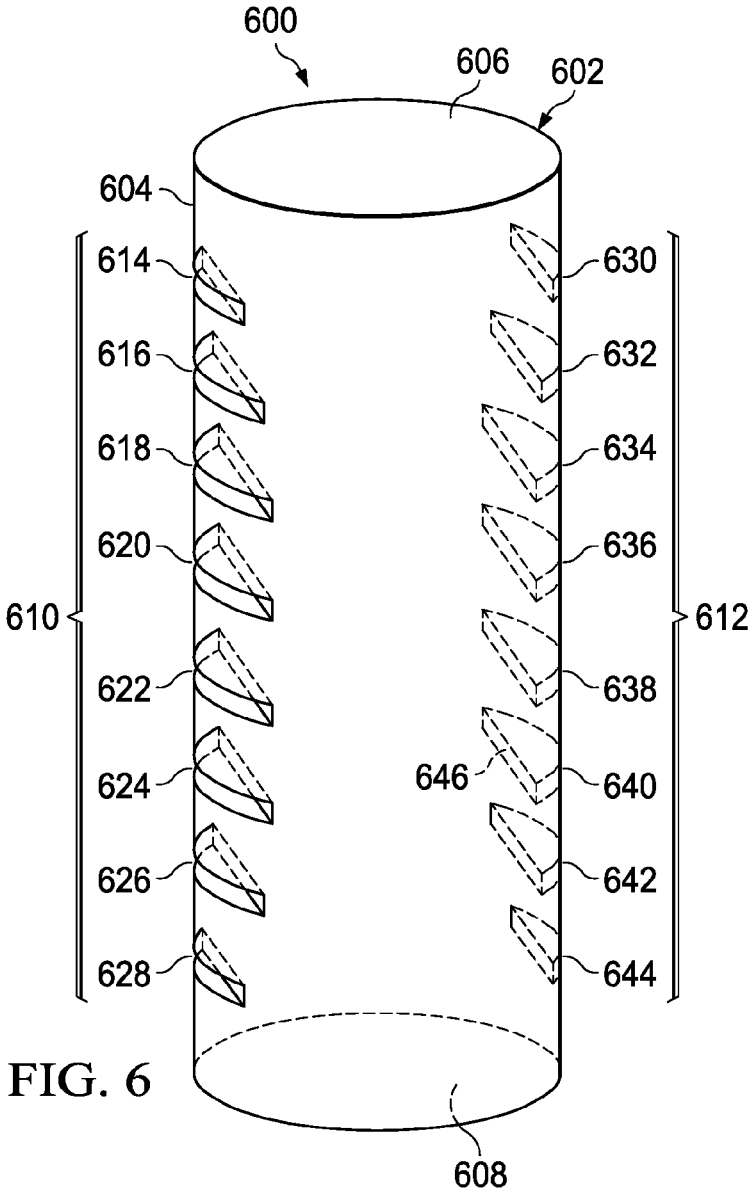
FIG. 6 is an isometric view of a metal plated grooved dielectric polarizer in accordance with an advantageous embodiment.

With reference now to FIG. 6, a diagram of a metal plated grooved dielectric polarizer is depicted in accordance with an advantageous embodiment. Polarizer 600 is illustrated in a perspective view and is an example of one implementation of polarizer 400 in FIG. 4.

In this example, polarizer 600 comprises dielectric rod 602 with metal plated sides 604. Dielectric rod 602 may have a dielectric constant of k=around 5.4 and a loss tangent equal to around 0.0005 material. End 606 and end 608 are not metal plated in these examples.

Array of slots 610 and array of slots 612 are formed in dielectric rod 602. Array of slots 610 is substantially opposite of array of slots 612 on dielectric rod 602. As can be seen, array of slots 610 and array of slots 612 may have different sized slots. Array of slots 610 contains slots 614, 616, 618, 620, 622, 624, 626, and 628. Array of slots 612 contains slots 630, 632, 634, 636, 638, 640, 642, and 644.

As can be seen, the slots within arrays of slots 610 and 612 may have different sizes and spacing. The sizes and spacing of array of slots 610 is a mirror image of the sizes and spacing for array of slots 612. In the illustrative examples, the metal plating of metal plated sides 604 also includes all of the sides, which define the slot. For example, sidewall 646 in slot 640 is metal plated.

Figure 7:
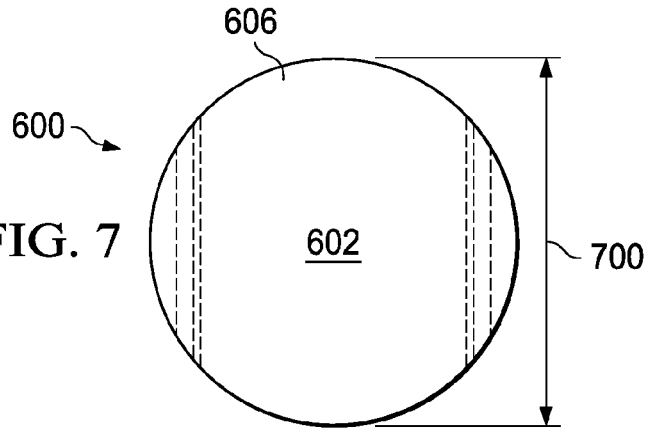
FIG. 7 is a top view of a polarizer in accordance with an advantageous embodiment.

With reference now to FIG. 7, a top view of a polarizer is depicted in accordance with an advantageous embodiment. In this example, end 606 of polarizer 600 may be seen from a top view. Diameter 700, in these examples, changes in size to cause a phase shift of around 90 degrees as a signal travels through polarizer 600. The dashed lines in this view are actually hidden lines. These lines would not be seen in an opaque dielectric used to form polarizer 600.

Figure 8:
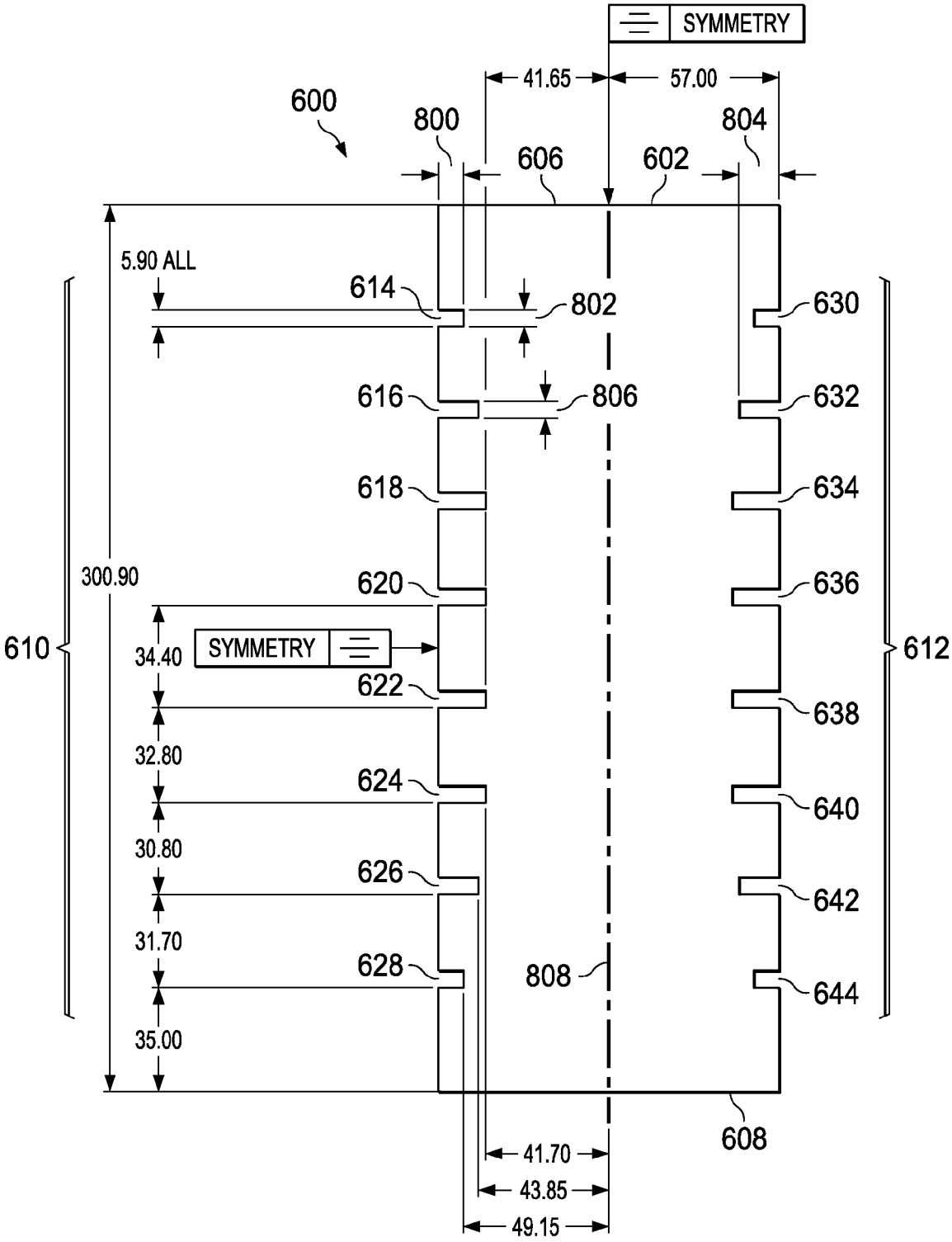
FIG. 8 is a cross-sectional side view of a polarizer in accordance with an advantageous embodiment.

With reference now to FIG. 8, a cross-sectional side view of a polarizer is depicted in accordance with an advantageous embodiment. As can be seen in this example, a side view of polarizer 600 is depicted in accordance with an advantageous embodiment. In this view, the different slots may have different depths and heights. For example, slot 630 has depth 800 and height 802, while slot 632 has depth 804 and height 806. Depth 800 is shallower than depth 804, and height 806 is greater than height 802. These dimensions are symmetric between array of slots 610 and array of slots 612 about axis 808. For example, slot 614 also has depth 800 and height 802, and slot 616 has depth 804 and height 806.

Figure 9:
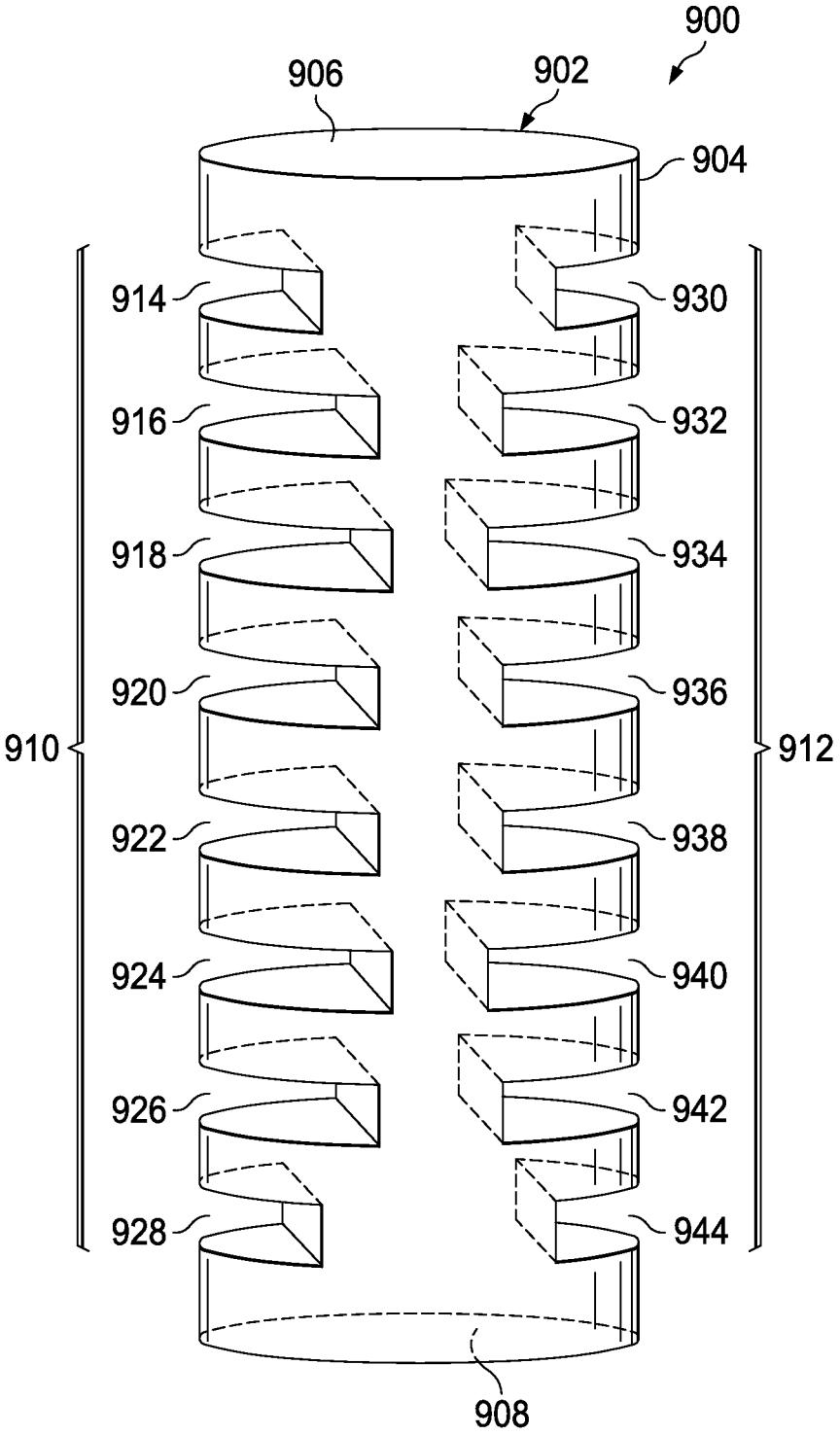
FIG. 9 is an isometric view of a polarizer in accordance with an advantageous embodiment.

With reference now to FIG. 9, a diagram of a polarizer is depicted in accordance with an advantageous embodiment. Polarizer 900 is illustrated in a perspective view and is an example of one implementation of polarizer 400 in FIG. 4.

Polarizer 900 is formed from dielectric rod 902. Dielectric rod 902 has a dielectric constant of k=around 5.4 and a loss tangent equal to around 0.0005 material. Dielectric rod 902 has sidewalls 904, end 906, and end 908. Additionally, dielectric rod 902 has array of slots 910 and array of slots 912 formed in sidewalls 904.

Array of slots 910 contains slots 914, 916, 918, 920, 922, 924, 926, and 928. Array of slots 912 contains slots 930, 932, 934, 936, 938, 940, 942, and 944. In this example, dielectric rod 902 does not have metal plating or coating for sidewalls 904. Instead, dielectric rod 902 must be placed into a round circular tube that is a waveguide for the antenna element.

Figure 10:
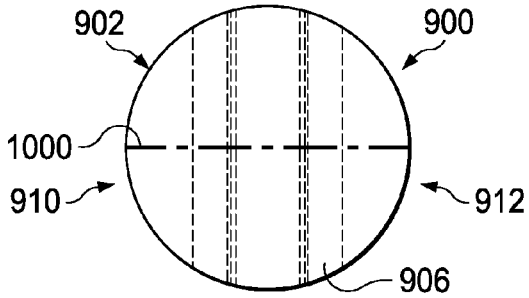
FIG. 10 is a top view of a polarizer in accordance with an advantageous embodiment.

With reference now to FIG. 10, a top view of a polarizer is depicted in accordance with an advantageous embodiment. In this example, a view of end 906 of dielectric rod 902 can be seen. As can be seen in this view, diameter 1000 may change as the sizes of slots within array of slots 910 and array of slots 912 change. The changes in the size of diameter 1000 may provide for a phase shift of around 90 degrees for a signal travelling through polarizer 900.

Figure 11:
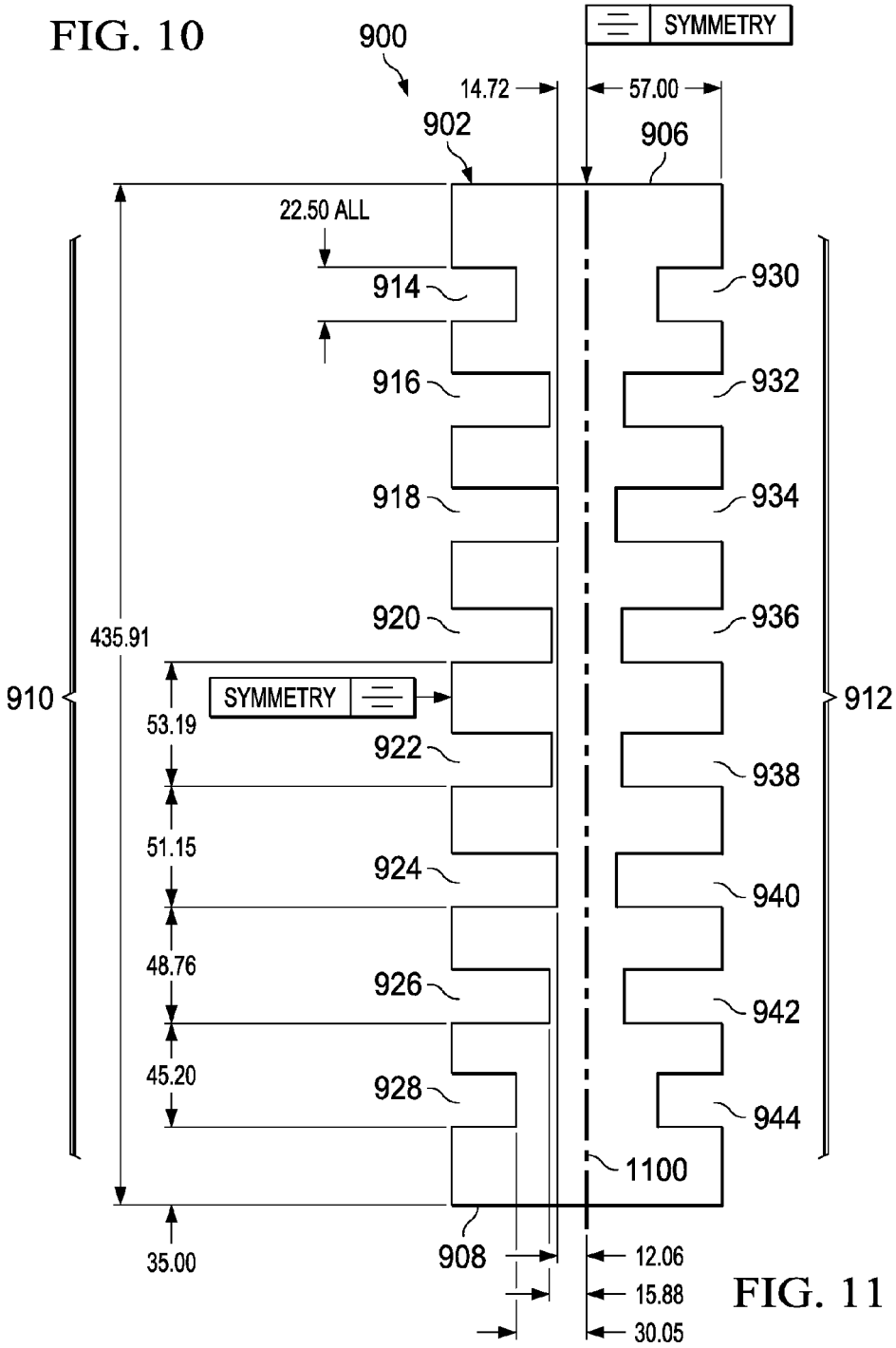
FIG. 11 is a cross-sectional side view of a polarizer in accordance with an advantageous embodiment.

Turning now to FIG. 11, a cross-sectional side view of a polarizer is depicted in accordance with an advantageous embodiment. In this example, a cross-sectional side view of dielectric rod 902 for polarizer 900 is illustrated. As can be seen, the different dimensions for slots are symmetric about axis 1100.

Figure 12:
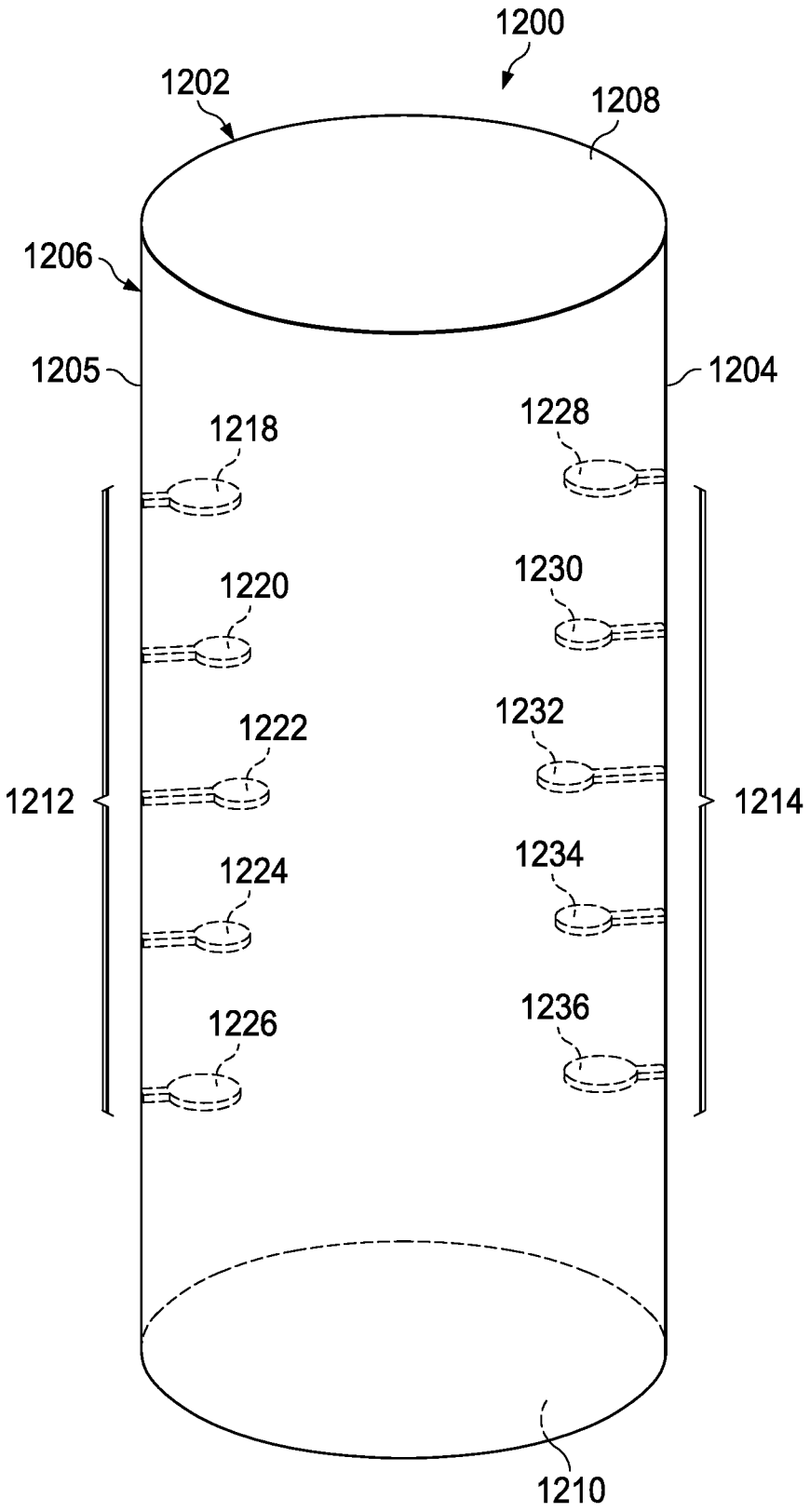
FIG. 12 is an isometric view of a polarizer in accordance with an advantageous embodiment.

With reference now to FIG. 12, a diagram of a polarizer is depicted in accordance with an advantageous embodiment. In this example, polarizer 1200 is an example of one implementation for polarizer 500 in FIG. 5. Polarizer 1200 may be constructed using printed wiring board laminates.

In this example, polarizer 1200 has cylinder 1202 formed from layers of substrates 1204. Layers of substrates 1204 have a dielectric constant of k=around 3.55 and a loss tangent of around 0.0027 material. In this example, layers of substrates 1204 forming cylinder 1202 have sidewalls 1205, end 1208, and end 1210. Array of tabs 1212 and array of tabs 1214 are substantially opposite to each other and formed within layers of substrates 1204. Edge metal plating 1206 is present on sidewalls 1205 on all layers of substrates 1204. Edge metal plating 1206 provides a connection to array of tabs 1212 and array of tabs 1214. This connection provides a ground connection in these examples.

Array of tabs 1212 includes tabs 1218, 1220, 1222, 1224, and 1226. Array of tabs 1214 include tabs 1228, 1230, 1232, 1234, and 1236. In these examples, the tabs have a circular shape with a path extending to edge metal plating 1206. In these examples, array of tabs 1212, array of tabs 1214, and edge metal plating 1206 may be formed by etching metal on layers of substrates 1204 during manufacturing of cylinder 1202. These tabs act as an iris inside of cylinder 1202. The tabs may provide a smaller diameter waveguide depending on the particular implementation.

Cylinder 1202 may be formed by boring out or cutting out cylinder 1202 from a stack of printed wire and board substrates that have been selectively etched to form the different features, such as tabs and edge metal plating, as illustrated in this example. Further, with edge metal plating 1206, a metal circular tube may not be needed because the edge metal plating may function as a circular waveguide.

Figure 13:
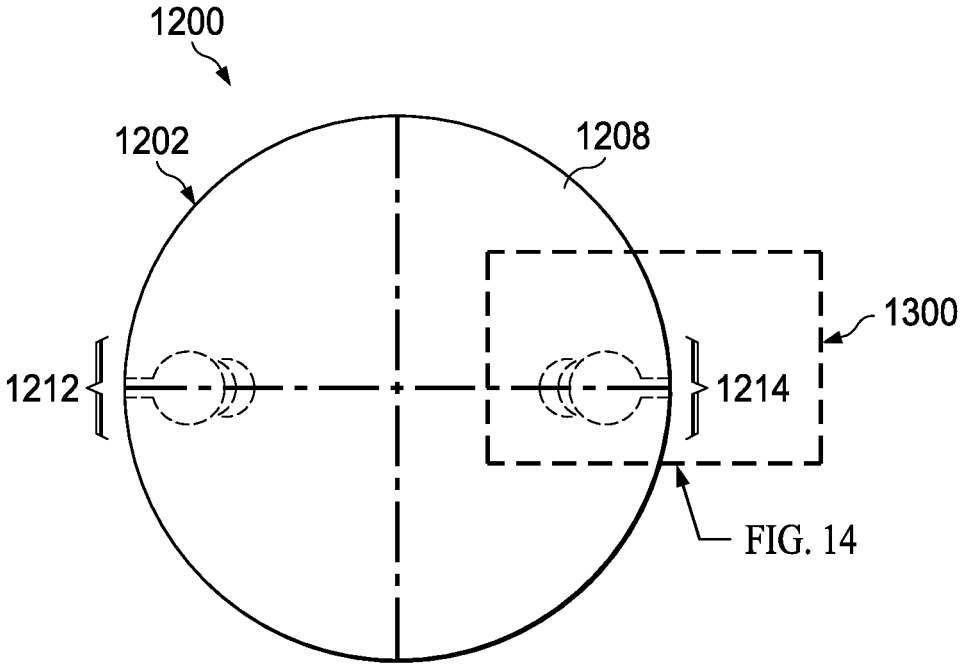
FIG. 13 is a top view of a polarizer in accordance with an advantageous embodiment.

With reference now to FIG. 13, a top view of a polarizer is depicted in accordance with an advantageous embodiment. In this example, end 1208 of polarizer 1200 may be seen.

Figure 14:
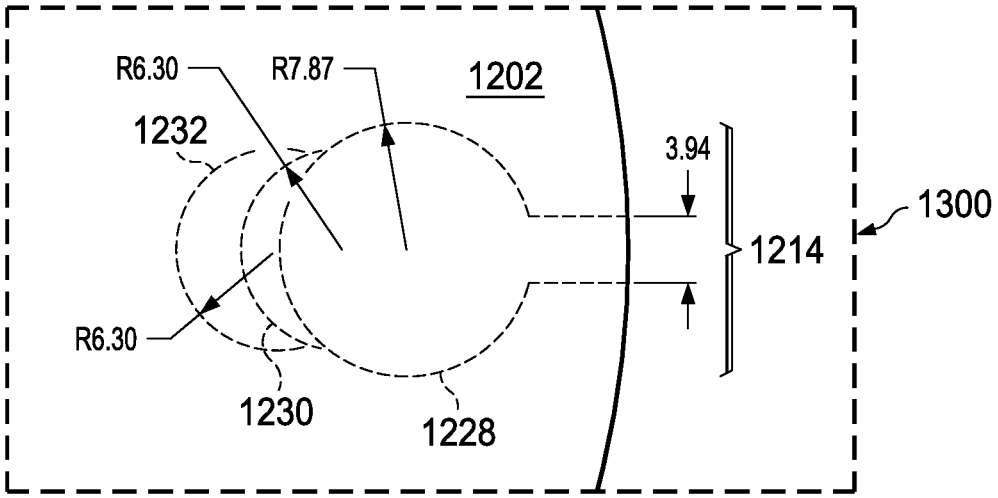
FIG. 14 is a magnified view of a portion of a polarizer in accordance with an advantageous embodiment.

With reference now to FIG. 14, a magnified view of a portion of a polarizer is depicted in accordance with an advantageous embodiment. In this illustrative example, a magnified view of section 1300 in FIG. 13 is depicted. As can be seen in this example, tabs within array of tabs 1214 have different sizes and depths. The sizes and depths for the different arrays of tabs are selected in a manner to cause a phase shift of around 90 degrees for a signal travelling through polarizer 1200.

Figure 15:
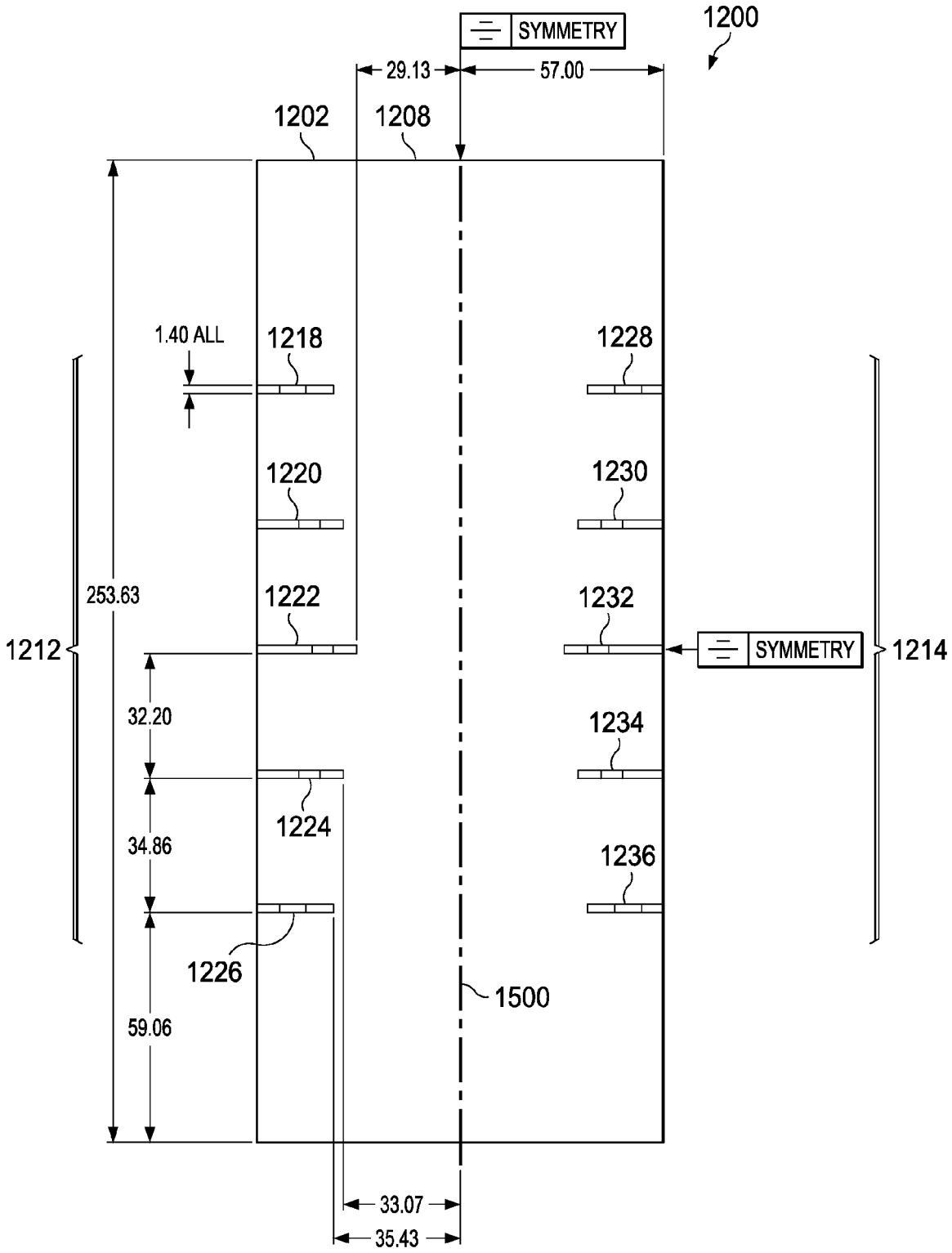
FIG. 15 is a cross-sectional side view of a polarizer in accordance with an advantageous embodiment.

With reference now to FIG. 15, a cross-sectional side view of a polarizer is depicted in accordance with an advantageous embodiment. In this example, the cross-sectional side view of polarizer 1200 shows symmetry of array of tabs 1212 and array of tabs 1214 about axis 1500.

Figure 16:
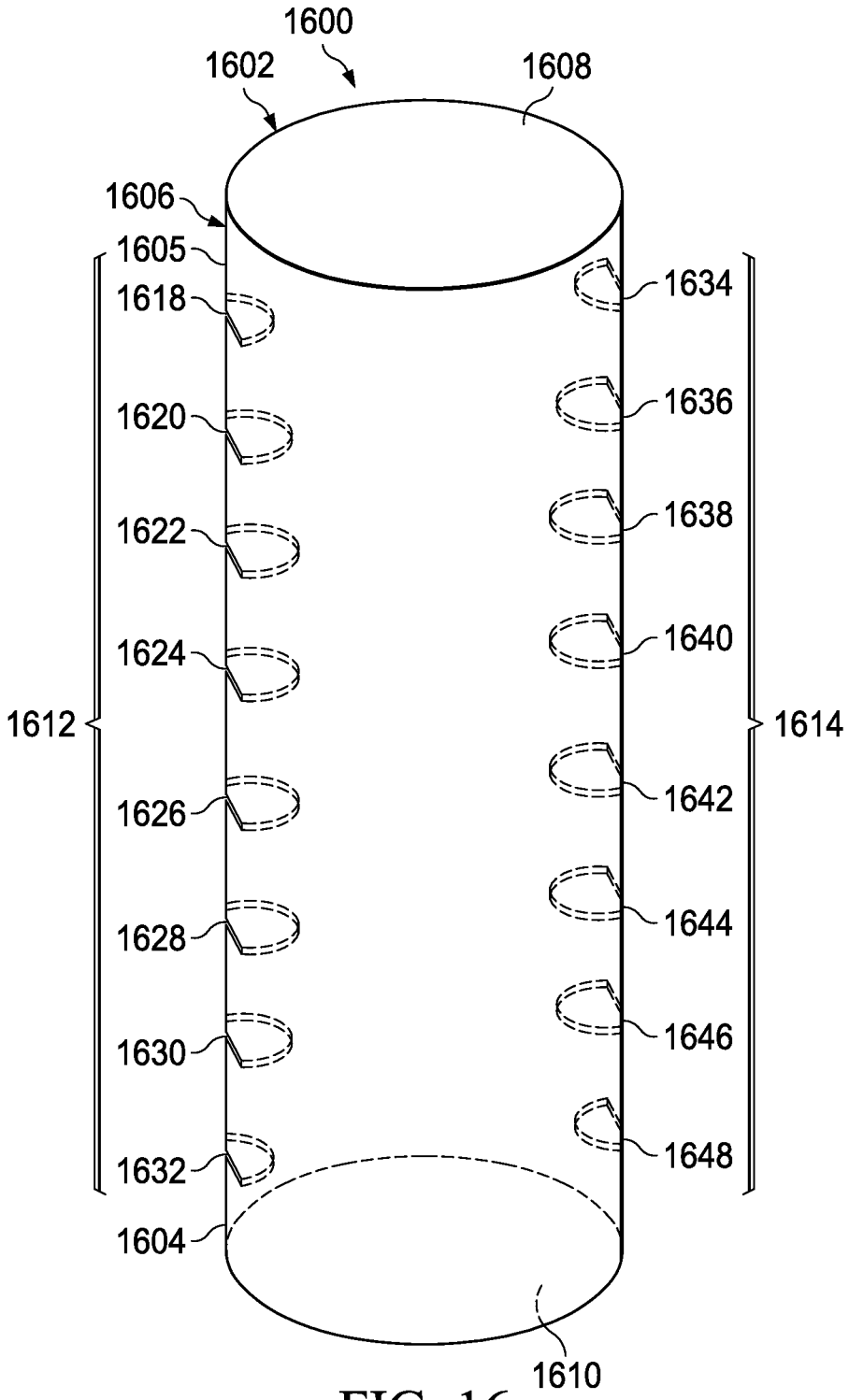
FIG. 16 is an isometric view of a polarizer constructed from layers of substrates in accordance with an advantageous embodiment.

With reference now to FIG. 16, a diagram of a polarizer constructed from layers of substrates is depicted in accordance with an advantageous embodiment. In this example, polarizer 1600 is illustrated in a perspective view and is an example of one implementation of polarizer 500 in FIG. 5.

Polarizer 1600 takes the form of cylinder 1602, which is comprised of layers of substrates 1604. Layers of substrates 1604 and cylinder 1602 have sidewalls 1605, end 1608, and end 1610. Array of tabs 1612 and array of tabs 1614 are formed on layers of substrates 1604 and cylinder 1602. The tabs in these examples have a semicircular shape.

Edge metal plating 1606 on sidewalls 1605 provides a connection with array of tabs 1612 and array of tabs 1614. The use of edge metal plating 1606 avoids needing to place cylinder 1602 into a metal tube because edge metal plating 1606 functions as a circular waveguide.

In these examples, array of tabs 1612 contains tabs 1618, 1620, 1622, 1624, 1626, 1628, 1630, and 1632. Array of tabs 1614 contains tabs 1634, 1636, 1638, 1640, 1642, 1644, 1646, and 1648. As can be seen, the different tabs have different dimensions and spacing within layers of substrates 1604 in cylinder 1602. These different dimensions in spacing are selected to cause a phase shift of around 90 degrees between orthogonal components of a signal travelling through polarizer 1600.

Further, the different dimensions and spacing also may be selected to reduce reflections that may occur as the signal travels through polarizer 1600. Further, polarizer 1600 does not require insertion into a round circular tube because edge metal plating 1606 act as a circular waveguide in these examples.

Figure 17:
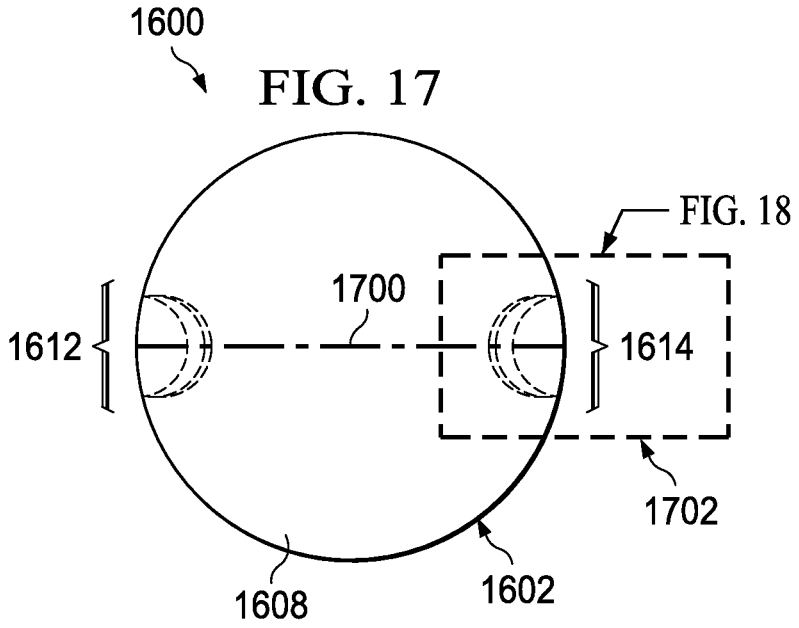
FIG. 17 is a top view of a polarizer in accordance with an advantageous embodiment.

With reference now to FIG. 17, a diagram of a top view of a polarizer is depicted in accordance with an advantageous embodiment. In this view, different tabs within array of tabs 1612 and array of tabs 1614 may be seen from end 1608. Diameter 1700 may change in size with the different dimensions of array of tabs 1612 and array of tabs 1614.

This change in diameter may be selected in a manner to cause a phase shift of around 90 degrees in a signal travelling through polarizer 1600. Array of tabs 1612 and array of tabs 1614 act as an iris changing diameter 1700. These tabs may provide a smaller size for diameter 1700 in a waveguide. The unique shape of these tabs may provide a flattest phase response at a given frequency for a given dielectric.

Figure 18:
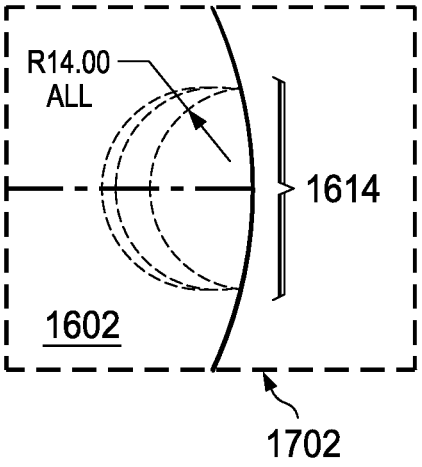
FIG. 18 is a magnified top view of a polarizer in accordance with an advantageous embodiment.

With reference now to FIG. 18, a magnified top view of a section of a polarizer is depicted in accordance with an advantageous embodiment. In this example, section 1702 is illustrated in a larger view.

Figure 19:
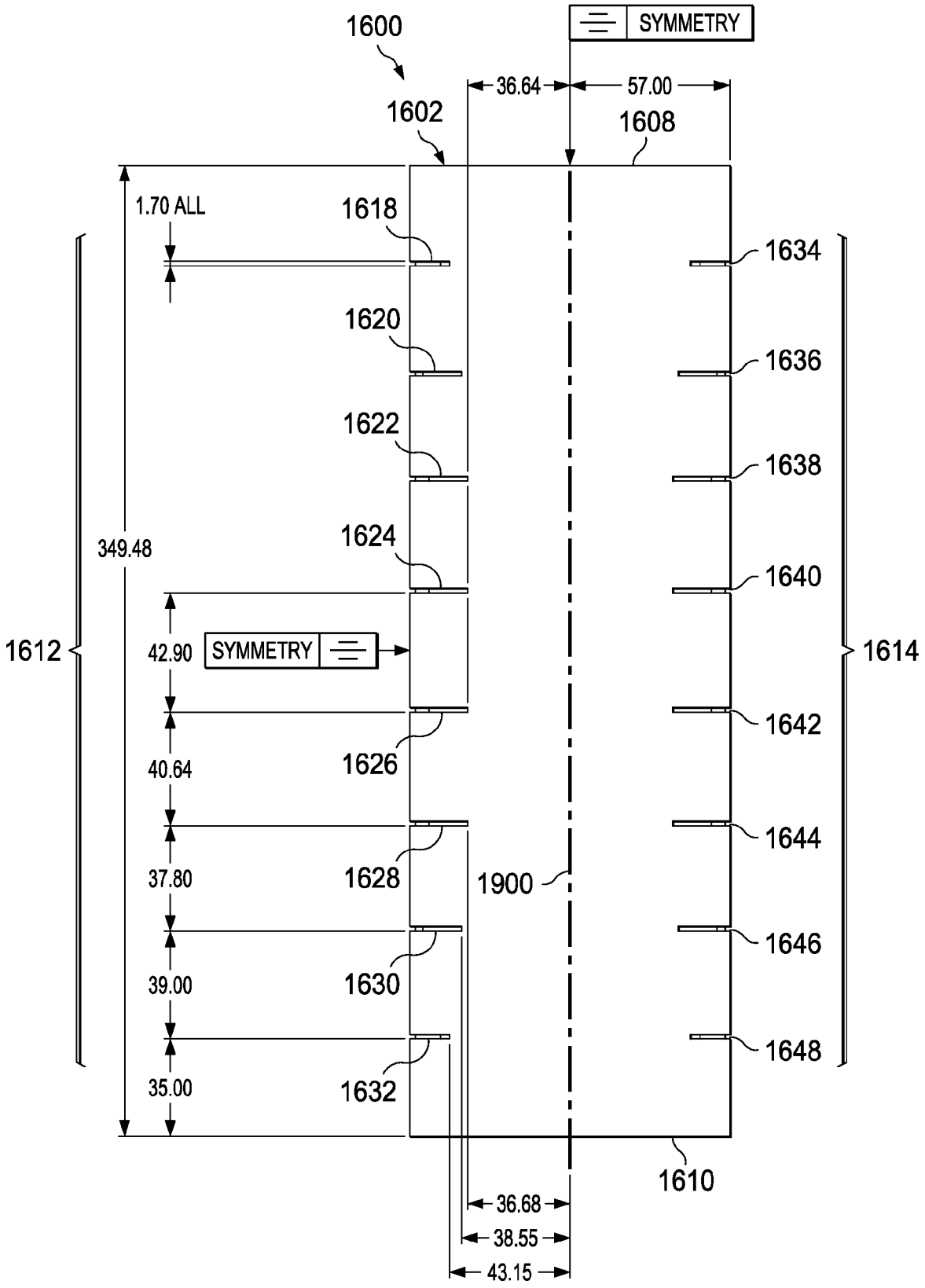
FIG. 19 is a cross-sectional side view of a polarizer with edge plating in accordance with an advantageous embodiment.

With reference now to FIG. 19, a cross-sectional side view of a polarizer is depicted in accordance with an advantageous embodiment. In this example, polarizer 1600 is seen in a cross-sectional side view. From this view, symmetry of array of tabs 1612 and array of tabs 1614 around axis 1900 is depicted.

Figure 20:
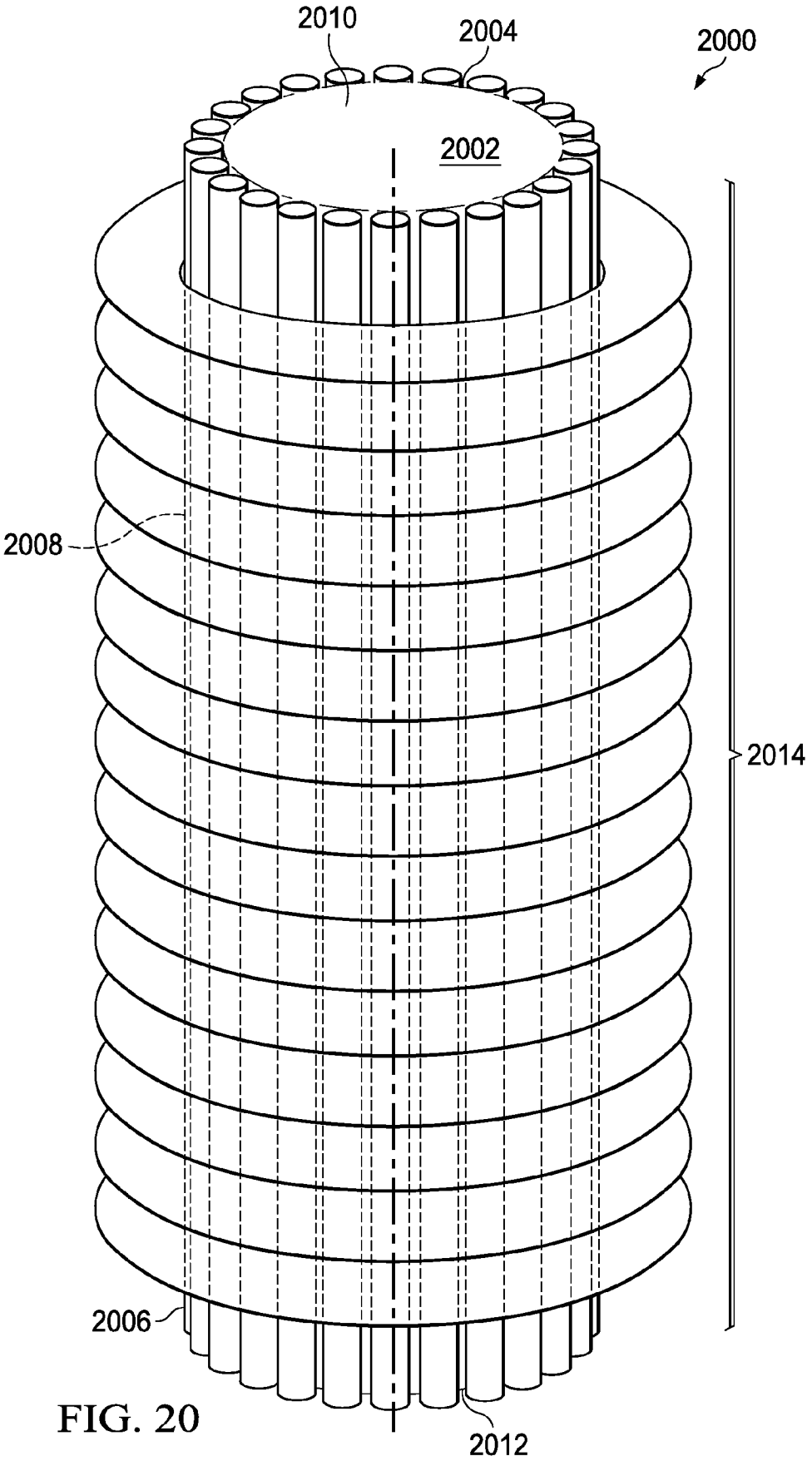
FIG. 20 is an isometric view of a polarizer with a metal ring of vias in accordance with an advantageous embodiment.

With reference now to FIG. 20, a diagram of a polarizer with a metal ring of vias is depicted in accordance with an advantageous embodiment. In this example, polarizer 2000 is illustrated in a perspective view and is an example of one implementation of polarizer 500 in FIG. 5.

Polarizer 2000 takes the form of cylinder 2002. In this example, layers of substrates 2004 is shown in phantom to provide a better view of ring of vias 2006. In this example, cylinder 2002 has sidewalls 2008, end 2010, and end 2012. Ring of vias 2006 is formed from arrays of vias, which are drilled through all layers within layers of substrates 2004. These arrays are arranged in a ring to form a structure that may function as a waveguide. Arrays of tabs are present within ring of vias 2006 but not seen in this perspective view of polarizer 2000. Further, polarizer 2000 may have metalized layers 2014.

Figure 21:
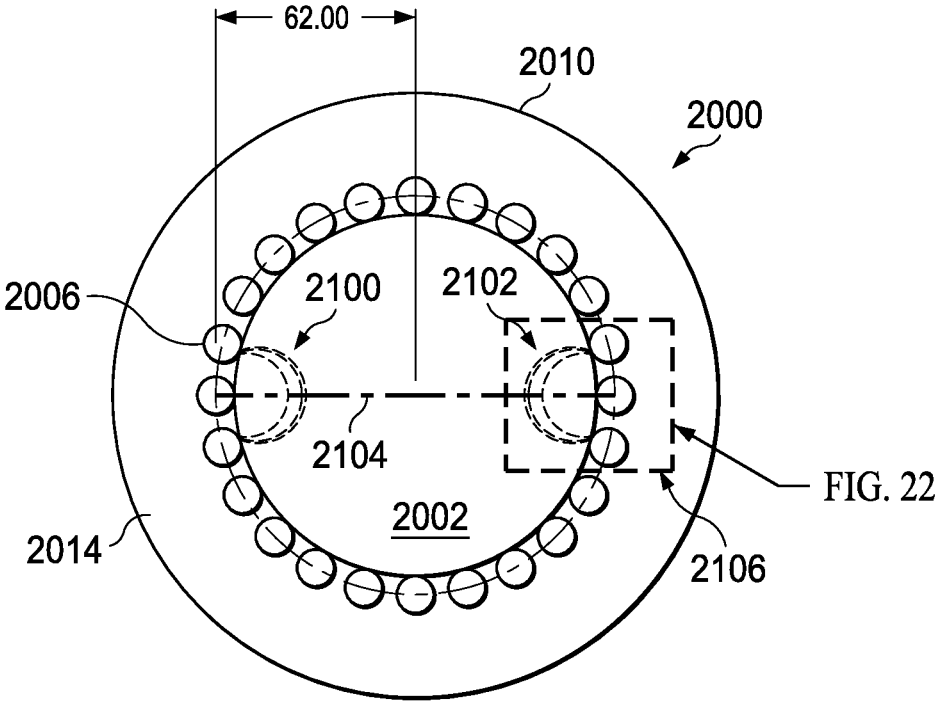
FIG. 21 is a top view of a polarizer in accordance with an advantageous embodiment.

With reference now to FIG. 21, a top view of a polarizer is depicted in accordance with an advantageous embodiment. In this example, end 2010 of polarizer 2000 is depicted. Metalized layers 2014 also can be seen in this view and extend throughout the printed wiring board. Metalized layers 2014 may be shown as terminated only in FIGS. 20-23 for convenience. Metalized layers 2014 are not necessarily terminated in the circular shape as depicted in this illustrative example for metalized layers 2014. In other words, metalized layers 2014 may extend for any distance and/or may have any shape, depending on the particular implementation.

As illustrated, array of tabs 2100 is substantially opposite to array of tabs 2102 located within ring of vias 2006. Array of tabs 2100 and array of tabs 2102 may have different dimensions to change diameter 2104 within cylinder 2002. Diameter 2104 may be changed in a manner that may shift a signal travelling through polarizer 2000 by around 90 degrees.

Figure 22:
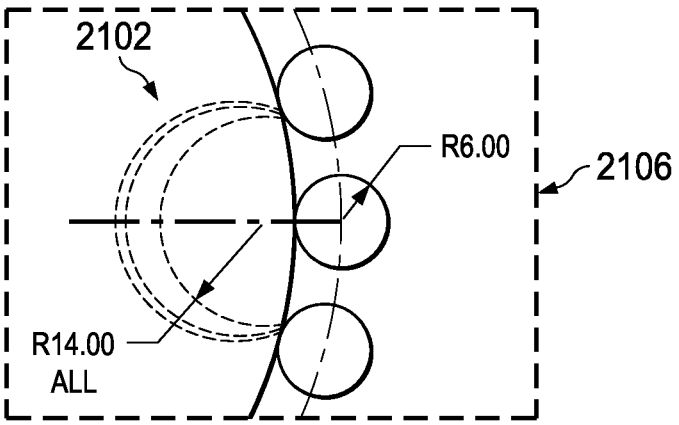
FIG. 22 is a magnified view of a portion of a polarizer in accordance with an advantageous embodiment.

Turning now to FIG. 22, a magnified view of a portion of a polarizer is depicted in accordance with an advantageous embodiment. In this example, a magnified view of section 2106 is illustrated. From this view, different dimensions for array of tabs 2102 are more visible.

Figure 23:
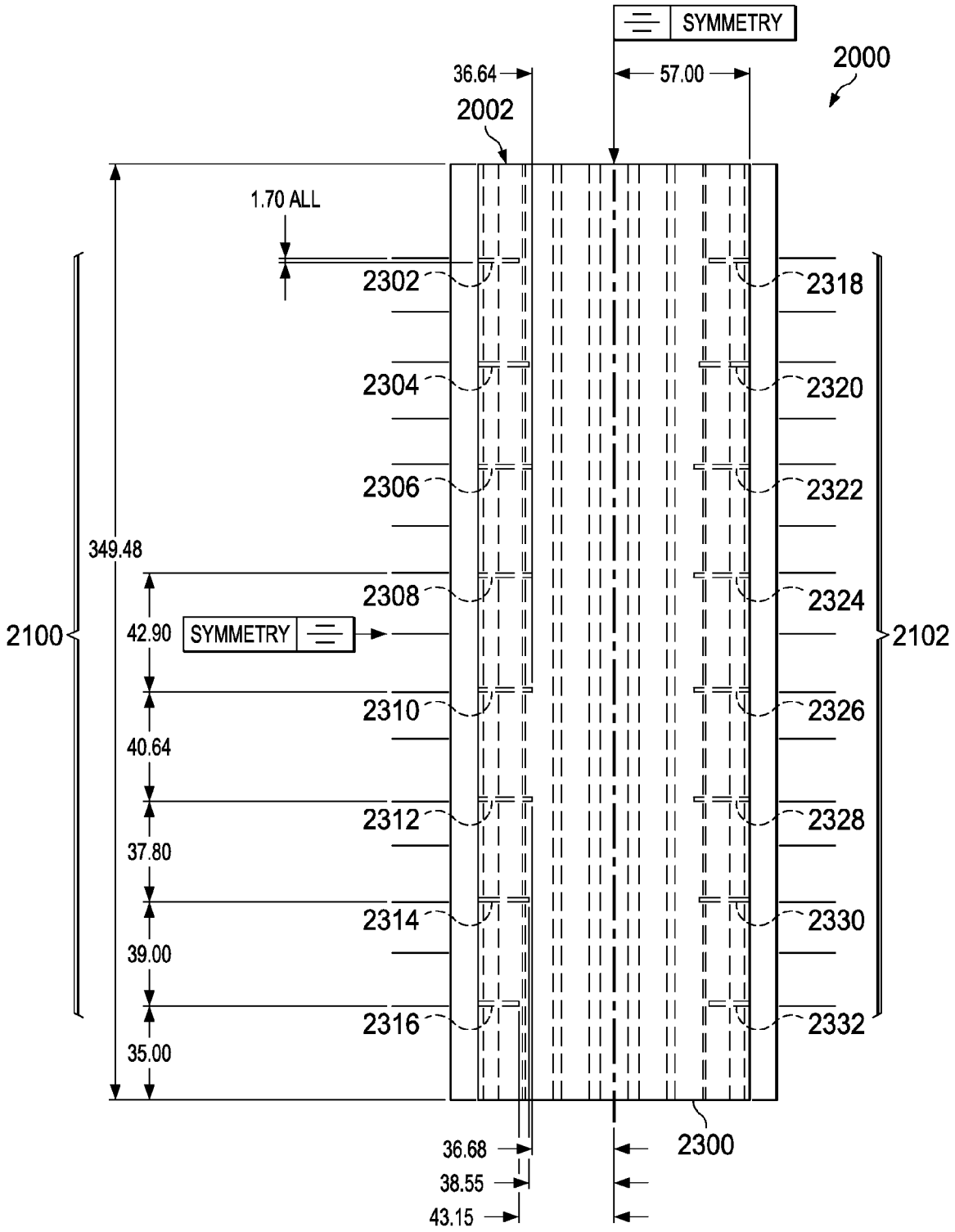
FIG. 23 is a cross-sectional side view of a polarizer in accordance with an advantageous embodiment.

With reference now to FIG. 23, a cross-sectional side view of a polarizer is depicted in accordance with an advantageous embodiment. In this example, polarizer 2000 is seen in a side view in which array of tabs 2100 and array of tabs 2102 are depicted as being symmetrical about axis 2300. Array of tabs 2100 includes tabs 2302, 2304, 2306, 2308, 2310, 2312, 2314, and 2316. Array of tabs 2102 contains tabs 2318, 2320, 2322, 2324, 2326, 2328, 2330, and 2332.

The illustration of the different polarizers in FIGS. 6-23 are not meant to imply physical or architectural limitations to the manner in which different polarizers may be implemented using different advantageous embodiments. The different polarizers illustrated in these figures are examples of some implementations for polarizer 400 in FIG. 4 and polarizer 500 in FIG. 5.

With reference now to FIG. 24, a top view of a diagram illustrating an array of polarizers is depicted in accordance with an advantageous embodiment. In this example, printed wiring board stack 2400 contains polarizers 2402. Each polarizer within polarizers 2402 has an architecture similar to polarizer 2000 as illustrated in FIGS. 20-23. Polarizers 2402 may be individually separated from printed wiring board stack 2400 and placed into an antenna to form antenna elements for an antenna array, or the whole printed wiring board itself may be placed on antenna elements of the same spacing.

With reference now to FIG. 25, a table illustrating performance of polarizers is depicted in accordance with an advantageous embodiment. In this example, table 2500 illustrates polarization for a number of polarizers simulated in accordance with an advantageous embodiment.

In this example, column 2502 identifies the polarizer, column 2504 identifies a frequency band, column 2506 identifies a worst case return loss for both orthogonally linear signals, column 2508 identifies a worst case insertion loss for both orthogonally linear signals, column 2510 identifies cross polarization between orthogonally oriented signals, and column 2512 identifies a phase shift. All simulated parameters are known terms, based on the well-known S-parameters. In these examples, entries 2514, 2516, 2518, 2520, and 2522 are present.

Entry 2514 illustrates polarizer 600 as depicted in FIGS. 6-8. Entry 2516 illustrates results for a simulation for polarizer 900 as depicted in FIGS. 9-11. Entry 2518 contains results for a simulation of polarizer 1200 as depicted in FIGS. 12-15. Entry 2520 contains results for a simulation of polarizer 1600 as depicted in FIGS. 16-19. Entry 2522 contains results for polarizer 2000 as depicted in FIGS. 20-23.

Figure 26:
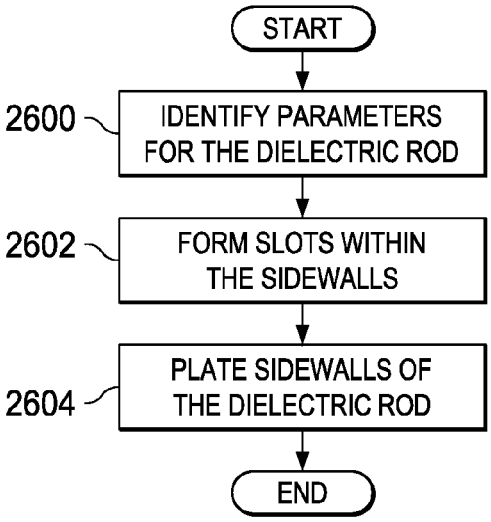
FIG. 26 is a flowchart of a process for forming a polarizer in accordance with an advantageous embodiment.

With reference now to FIG. 26, a flowchart of a process for forming a polarizer is depicted in accordance with an advantageous embodiment. The process illustrated may be used to manufacture a polarizer such as, for example, polarizer 304 in FIG. 3.

The process begins by identifying parameters for the dielectric rod (operation 2600). These parameters may include, for example, a length of the dielectric rod, a diameter for the dielectric rod, a number of slots in each array of slots, a size of the different slots, a shape for the slots, and/or other suitable parameters. These parameters may be identified to provide a shift of a signal of around 90 degrees and/or reduce reflections that may occur while the signal is travelling through the dielectric rod. The process then forms slots within the sidewalls (operation 2602). Thereafter, sidewalls of the dielectric rod are plated (operation 2604), with the process terminating thereafter.

Depending on the particular implementation, adding a metal coat to the dielectric rod may be omitted, and the polarizer may be placed into a circular tube which forms a waveguide.

Figure 27:
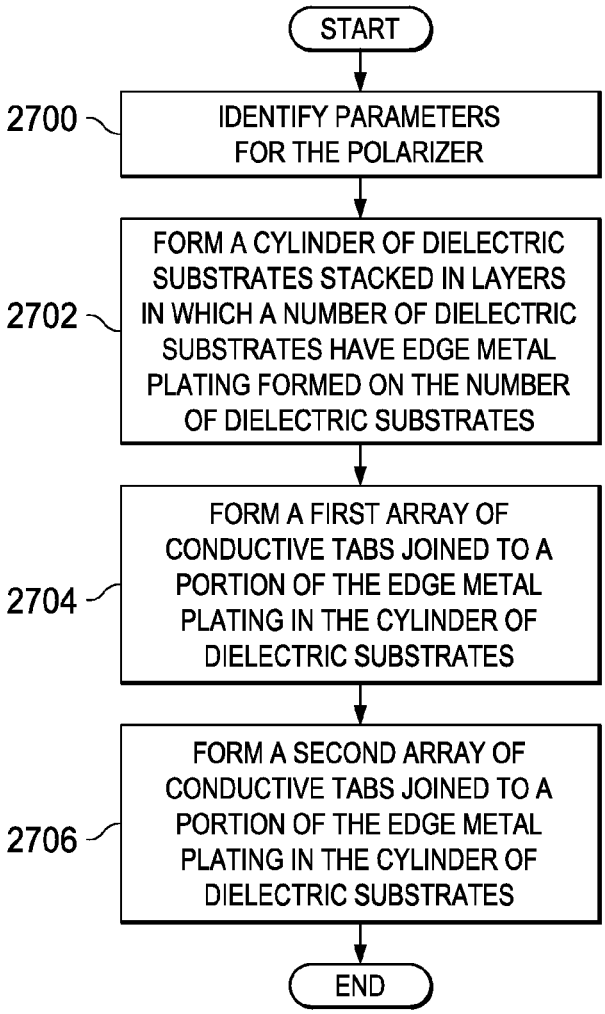
FIG. 27 is a flowchart of a process for manufacturing a polarizer in accordance with an advantageous embodiment.

With reference now to FIG. 27, a flowchart of a process for manufacturing a polarizer is depicted in accordance with an advantageous embodiment. The process illustrated in FIG. 27 may be used to manufacture a polarizer such as, for example, polarizer 500 in FIG. 5.

The process begins by identifying parameters for the polarizer (operation 2700). The process then forms a cylinder of dielectric substrates stacked in layers in which a number of dielectric substrates have edge metal plating formed on the number of dielectric substrates (operation 2702).

The process forms a first array of conductive tabs joined to a first portion of the edge metal plating in the cylinder of dielectric substrates (operation 2704). The process also forms a second array of conductive tabs joined to a second portion of the edge metal plating in the cylinder of dielectric substrates substantially opposite to the first array of conductive tabs (operation 2706), with the process terminating thereafter.

Although the illustration of different operations in the figures is shown as being sequential, some steps may be performed in parallel. In yet other advantageous embodiments, some operations may be included in addition to, or in place of, the ones illustrated.

Figure 28:
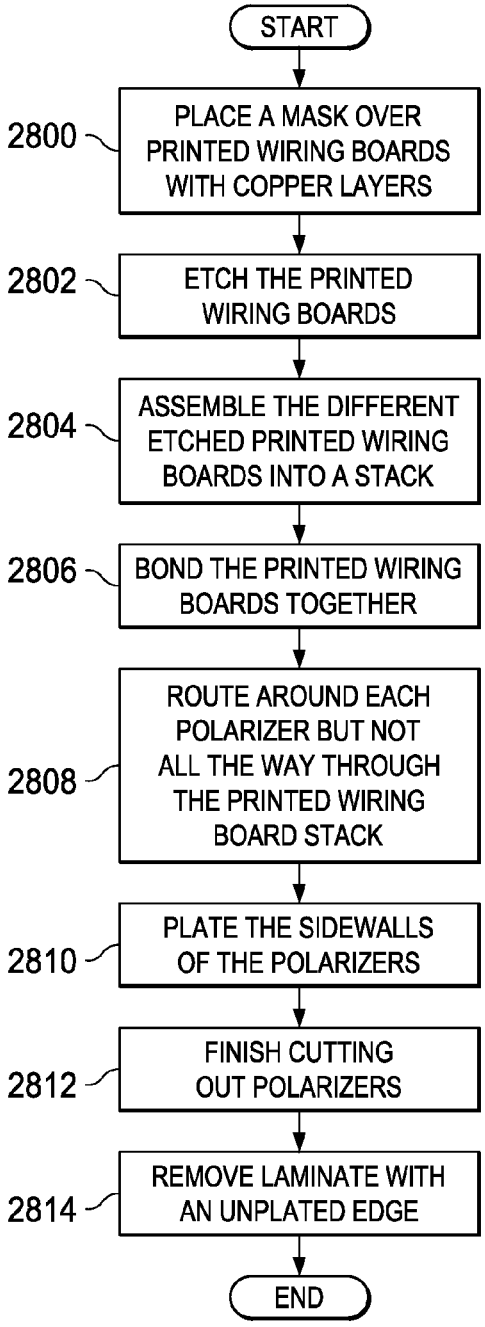
FIG. 28 is a flowchart of a process for manufacturing a polarizer using printed wiring board processes in accordance with an advantageous embodiment.

With reference now to FIG. 28, a flowchart of a process for manufacturing a polarizer using printed wiring board processes is depicted in accordance with an advantageous embodiment. The process illustrated in FIG. 28 may be used to manufacture a polarizer such as, for example, polarizer 500 in FIG. 5.

The process begins by placing a mask over printed wiring boards with copper layers (operation 2800). The mask may expose areas in which copper plating is to be removed. The mask covers areas such as, for example, tabs, edge plating, and/or other desirable conductive structures. Different substrate layers or sheets may have different masks to provide for the different types of tabs and spacing of tabs. The process then etches the printed wiring boards (operation 2802). The different etched printed wiring boards are assembled into a stack (operation 2804). This stack may contain arrays of polarizers similar to polarizers 2402 illustrated in FIG. 24.

The process then bonds the printed wiring boards together (operation 2806). The process then routes around each polarizer, but not all the way through the printed wiring board stack (operation 2808). This routing operation provides a space around the sidewalls of the polarizers for edge metal plating. The process then plates the sidewalls of the polarizers (operation 2810). The process then finishes cutting out the polarizers (operation 2812). The laminate with an unplated edge is removed (operation 2814), with the process terminating thereafter.

Figure 29:
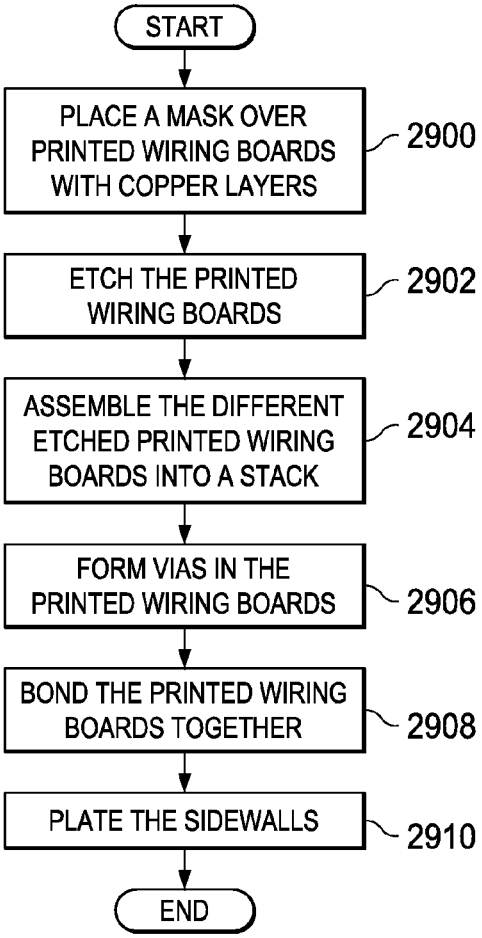
FIG. 29 is a flowchart of a process for manufacturing an array of polarizers using a printed wiring board process in accordance with an advantageous embodiment.

With reference now to FIG. 29, a flowchart of a process for manufacturing an array of polarizers using a printed wiring board process is depicted in accordance with an advantageous embodiment. The process illustrated in FIG. 29 may be implemented to manufacture a polarizer such as, for example, polarizer 500 in FIG. 5.

The process begins by placing a mask over printed wiring boards with copper layers (operation 2900). The process then etches the printed wiring boards (operation 2902). The different etched printed wiring boards are assembled into a stack (operation 2904). The process then forms vias in the printed wiring boards (operation 2906). These vias may be formed by drilling holes into the locations for vias.

The printed wiring boards are then bonded together (operation 2908). The process then plates the sidewalls (operation 2910), with the process terminating thereafter.

Thus, the different advantageous embodiments provide a method and apparatus for waveguide polarizers using dielectric rods or printed wiring board technologies. The different advantageous embodiments provide circular polarizers that may use slots forming an air iris or tabs forming a metal iris to shift a first component orthogonal to a second component in a signal traveling through the dielectric rod by around 90 degrees with respect to each other. Further, the different advantageous embodiments also provide a capability to manufacture polarizers in a faster and less expensive manner as compared to currently available polarizers.

The description of the different advantageous embodiments has been presented for purposes of illustration and description, and it is not intended to be exhaustive or limited to the embodiments in the form disclosed. Many modifications and variations will be apparent to those of ordinary skill in the art. Further, different advantageous embodiments may provide different advantages as compared to other advantageous embodiments.

The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a dielectric rod;

a first array of slots formed in sidewalls of the dielectric rod; and a second array of slots formed in the sidewalls of the dielectric rod, wherein the first array of slots is substantially opposite to the second array of slots, and wherein the first array of slots and the second array of slots are configured to shift a first component orthogonal to a second component in a signal traveling through the dielectric rod by around 90 degrees with respect to each other.

2. The apparatus of claim 1 further comprising:

a layer of metal covering the sidewalls of the dielectric rod and walls defining the first array of slots and the second array of slots.

3. The apparatus of claim 1 further comprising:

a metal tube having a channel capable of receiving the dielectric rod.

4. The apparatus of claim 3, wherein the metal tube is a waveguide.

5. The apparatus of claim 1, wherein slots within the first array of slots are unequally spaced from each other and slots within the second array of slots are unequally spaced from each other.

6. The apparatus of claim 1, wherein at least a portion of the first array of slots and at least a portion of the second array of slots have different sizes.

7. The apparatus of claim 1, wherein slots in the first array of slots and the second array of slots are selected from a plurality of rectangular slots and a plurality of angled slots.

8. A method for manufacturing a polarizer, the method comprising:

identifying parameters for a dielectric rod, a first array of slots, and a second array of slots, wherein the first array of slots is substantially opposite to the second array of slots; and forming the first array of slots and the second array of slots in sidewalls of the dielectric rod such that a first component orthogonal to a second component in a signal traveling through the dielectric rod shifts by around 90 degrees with respect to each other.

9. The method of claim 8 further comprising:

forming a layer of metal on the sidewalls.

10. The method of claim 8 further comprising:

placing the dielectric rod with the first array of slots and the second array of slots in a metal tube to form an antenna element.

* * * * *